US012781365B2

(12) United States Patent
Ohno et al.

(10) Patent No.: US 12,781,365 B2
(45) Date of Patent: Nov. 3, 2026

(54) METHOD OF OPERATING ELECTROLYSIS APPARATUS

(71) Applicant: ASAHI KASEI KABUSHIKI KAISHA, Tokyo (JP)

(72) Inventors: Jun Ohno, Tokyo (JP); Yousuke Uchino, Tokyo (JP)

(73) Assignee: ASAHI KASEI KABUSHIKI KAISHA, Tokyo (JP)

( * ) Notice: Subject to any disclaimer, the term of this patent is extended or adjusted under 35 U.S.C. 154(b) by 1067 days.

(21) Appl. No.: 17/595,861

(22) PCT Filed: Apr. 22, 2020

(86) PCT No.: PCT/JP2020/017357
§ 371 (c)(1),
(2) Date: Nov. 29, 2021

(87) PCT Pub. No.: WO2020/241129
PCT Pub. Date: Dec. 3, 2020

(65) Prior Publication Data

US 2022/0316081 A1 Oct. 6, 2022

(30) Foreign Application Priority Data

May 31, 2019 (JP) ..... 2019-103103
May 31, 2019 (JP) ..... 2019-103106

(51) Int. Cl.
*C25B 15/02* (2021.01)
*C25B 9/19* (2021.01)

(52) U.S. Cl.
CPC ..... *C25B 15/02* (2013.01); *C25B 9/19* (2021.01)

(58) Field of Classification Search
CPC ..... C25B 1/04; C25B 15/02
See application file for complete search history.

(56) References Cited

U.S. PATENT DOCUMENTS 3,573,189 A 3/1971 Westerlund
4,561,949 A 12/1985 Miles et al.
(Continued)

FOREIGN PATENT DOCUMENTS

EP 2415907 A1 2/2012
EP 3604617 A1 2/2020
(Continued)

OTHER PUBLICATIONS

Nov. 16, 2021, International Preliminary Report on Patentability issued in the International Patent Application No. PCT/JP2020/017357.

(Continued)

*Primary Examiner* — Alexander W Keeling
(74) *Attorney, Agent, or Firm* — KENJA IP LAW PC

(57) ABSTRACT

Provided is a method of operating an electrolysis apparatus that can inhibit electrode degradation under a variable power supply. The method of operating an electrolysis apparatus includes: an energization step in which electrolysis of electrolyte is performed in an anode compartment including an anode and a cathode compartment including a cathode that are partitioned from each other by a membrane; a suspension step in which electrolysis of electrolyte in the anode compartment and the cathode compartment is suspended; and a discharge step of, in the suspension step, electrically connecting an electrolyzer of the electrolysis apparatus to an external load and adjusting a cell voltage to 0.1 V or less in 5 hours or less.

5 Claims, 7 Drawing Sheets

(56) References Cited

U.S. PATENT DOCUMENTS

| | | | | |
|---|---|---|---|---|
| 2007/0131541 | A1* | 6/2007 | Miyashita | C25B 9/23 204/257 |
| 2009/0194411 | A1 | 8/2009 | Antozzi et al. | |
| 2013/0168237 | A1* | 7/2013 | Sugimasa | C25B 1/04 204/230.6 |
| 2014/0202875 | A1* | 7/2014 | Mofakhami | C25B 1/22 204/252 |
| 2016/0194769 | A1 | 7/2016 | Arai et al. | |
| 2017/0271695 | A1* | 9/2017 | Kemmer | H01M 8/04873 |
| 2020/0063274 | A1 | 2/2020 | Funakawa et al. | |
| 2020/0240028 | A1 | 7/2020 | Kobayashi et al. | |
| 2021/0046423 | A1* | 2/2021 | Ardo | B01D 69/12 |
| 2021/0363651 | A1* | 11/2021 | Seymour | H02M 7/219 |

FOREIGN PATENT DOCUMENTS

| | | | |
|---|---|---|---|
| JP | S3514825 | B | 10/1960 |
| JP | S51161448 | U | 12/1976 |
| JP | S6240438 | B2 | 8/1987 |
| JP | H09192670 | A * | 7/1997 |
| JP | 2000054177 | A | 2/2000 |
| JP | 2003094060 | A | 4/2003 |
| JP | 2006283158 | A | 10/2006 |
| JP | 2010242126 | A | 10/2010 |
| JP | 5553605 | B2 | 7/2014 |
| JP | 2017020053 | A | 1/2017 |
| JP | 2017206731 | A | 11/2017 |
| WO | 2006058369 | A1 | 6/2006 |
| WO | 2012043085 | A1 | 4/2012 |
| WO | 2015098058 | A1 | 7/2015 |
| WO | 2018139597 | A1 | 8/2018 |
| WO | 2018168863 | A1 | 9/2018 |
| WO | 2018174281 | A1 | 9/2018 |
| WO | 2019078141 | A1 | 4/2019 |

OTHER PUBLICATIONS

Aug. 25, 2022, the Partial Supplementary European Search Report issued by the European Patent Office in the corresponding European Patent Application No. 20813694.5.

Jul. 21, 2020, International Search Report issued in the International Patent Application No. PCT/JP2020/017357.

Nov. 30, 2022, the Supplementary European Search Report issued by the European Patent Office in the corresponding European Patent Application No. 20813694.5.

* cited by examiner

METHOD OF OPERATING ELECTROLYSIS APPARATUS

TECHNICAL FIELD

The present disclosure relates to a method of operating an electrolysis apparatus.

BACKGROUND

In recent years, techniques utilizing renewable energy, such as wind power generation and solar power generation, have attracted attention in order to address issues including global warming due to greenhouse gases such as carbon dioxide, decreasing fossil fuel reserves, and so on.

The nature of renewable energy is that it is subject to very large fluctuation as its output depends on climatic conditions. It is thus not always possible to transport electric power obtained through electricity generation by renewable energy to the general electric power system, and there is concern about social influences such as imbalance of electricity supply and demand, electric power system destabilization, and so on.

Therefore, research is being conducted in relation to converting electric power generated from renewable energy into a form suitable for storage and transportation, and then utilizing the electric power in this form. Specifically, studies have been made on how to generate storable and transportable hydrogen by electrolysis of water using electric power generated from renewable energy, and to use hydrogen as an energy source or material.

Hydrogen is widely used industrially in fields such as petroleum refining, chemical synthesis, and metal refining, and, in recent years, the potential for use in hydrogen stations for fuel cell vehicles (FCVs), smart communities, hydrogen power plants, and so forth has been expanding. For this reason, there is high expectation for the development of technology for obtaining hydrogen, in particular, from renewable energy.

Methods for electrolysis of water include solid polymer electrolyte water electrolysis, high-temperature steam electrolysis, and alkaline water electrolysis. Of these methods, alkaline water electrolysis is regarded as one of the most promising because of its industrialization over decades, capability for large-scale implementation, and inexpensiveness as compared to other water electrolysis systems.

However, in order to adopt alkaline water electrolysis as a means for storing and transporting energy in the future, it is necessary to enable efficient and stable use of electric power with large fluctuation in output as described above to perform water electrolysis, and various issues associated with electrolytic cells and apparatuses used for alkaline water electrolysis need to be resolved.

For example, in order to address an issue of improving electric power consumption in hydrogen production by suppressing the bath voltage in alkaline water electrolysis, it is known to be effective to use an electrolytic cell structure referred to as a zero-gap structure, which is a structure in which gaps between a membrane and electrodes are substantially eliminated (refer to Patent Literature (PTL) 1 and 2). With the zero-gap structure, by enabling rapid escape of evolved gas through pores in an electrode to the side opposite to the membrane side of the electrode, it is possible to reduce the distance between electrodes while minimizing gas accumulation near the electrodes as much as possible and maintaining a low bath voltage. The zero-gap structure is very effective in suppressing bath voltage and is adopted in various electrolysis apparatuses.

CITATION LIST

Patent Literature

PTL 1: JP5553605B2
PTL 2: WO2015/098058A1

SUMMARY

Technical Problem

However, when a conventional electrolysis apparatus is operated under a variable power supply such as sunlight or wind power, there are instances in which electrical charge that has accumulated in an anode and a cathode during electrolysis operation flows in a reverse direction in the anode and the cathode during suspension of electrolysis to generate a reverse current.

Moreover, in accompaniment to generation of a reverse current during suspension of electrolysis in this manner, the electrical potentials of the electrodes gradually change and thereby converge. In the process of electrical potential convergence, there is a certain period of time during which the electrical potential of the anode or cathode passes through a specific potential region in which a reverse reaction of a redox reaction of the anode or cathode during normal electrolysis operation occurs and in which the electrode itself is corroded. Consequently, there is a concern that degradation of the electrodes may occur upon repeated suspension and operation of electrolysis under a variable power supply.

Moreover, in a situation in which a reverse current is generated, a reverse reaction of a redox reaction during electrolysis operation occurs at the anode and the cathode, and thus there is a concern that degradation of the electrodes, and particularly of the cathode may occur upon repeated suspension and operation of electrolysis under a variable power supply. In response to these concerns, it is thought that by supplying hydrogen into a cathode compartment during suspension of electrolysis so as to bring the cathode and hydrogen into contact, an oxidation reaction of the cathode itself does not occur, and cathode degradation is effectively prevented. However, in an electrolytic cell of a conventional electrolysis apparatus, a vertical direction upper end of a cathode 102*c* and a covered upper end 104*t* of a membrane 104 (upper end in vertical direction D1 for a part of the membrane 104 that is not covered by a gasket 107, etc.) have the same vertical direction position as illustrated in FIGS. 7A and 7B, and, in a situation in which a waterline L (water surface position of electrolyte) in the electrolytic cell 165 is lowered below the upper end of the cathode 102*c* as illustrated in FIG. 7A in order to bring hydrogen into contact with the cathode 102*c* during suspension of electrolysis, parts (both sides) of the membrane 104 partitioning the electrolytic cell 165 into an anode compartment 105*a* and a cathode compartment 105*c* each become exposed to a gas layer present inside the electrolytic cell 165. When the membrane 104 is exposed to the gas layer in this manner, gases respectively present in the electrode compartments 105*a* and 105*c* may slightly permeate through the membrane 104 and diffuse in the electrode compartments 105*a* and 105*c*. For example, there may be a localized increase of the hydrogen concentration in oxygen inside the anode compartment 105*a* and of the oxygen concentration in hydrogen inside the cathode compartment 105*c*. Conversely, in a case in which the waterline L inside an electrolytic cell 165 of a conventional electrolysis apparatus has been raised during suspension of electrolysis such that a membrane 104 is not exposed to a gas layer with the aim of preventing the diffusion of gases in electrode compartments 105*a* and 105*c* described above, it has not been possible to bring a cathode 102*c* into contact with hydrogen at the upper end thereof and it has not been possible to prevent degradation of the cathode 102*c*.

Accordingly, an object of the present disclosure is to inhibit electrode degradation under a variable power supply.

In particular, an object of aspect (I) of the present disclosure is to provide a method of operating an electrolysis apparatus that can inhibit electrode degradation under a variable power supply. Moreover, an object of aspect (II) of the present disclosure is to provide an electrolysis apparatus that can inhibit cathode degradation under a variable power supply and can also inhibit gas diffusion and mixing between electrode compartments via a membrane.

Solution to Problem

The primary features of aspect (I) of the present disclosure are as follows.

<1> A method of operating an electrolysis apparatus that includes an anode compartment including an anode and a cathode compartment including a cathode and in which the anode compartment and the cathode compartment are partitioned from each other by a membrane, the method comprising:

an energization step in which electrolysis of electrolyte in the anode compartment and the cathode compartment is performed;

a suspension step in which electrolysis of electrolyte in the anode compartment and the cathode compartment is suspended; and a discharge step of, in the suspension step, electrically connecting an electrolyzer of the electrolysis apparatus to an external load and adjusting a cell voltage to 0.1 V or less in 5 hours or less.

<2> The method of operating an electrolysis apparatus according to <1>, wherein the cell voltage is adjusted to 0.1 V or less in 60 minutes or less in the discharge step.

<3> The method of operating an electrolysis apparatus according to <1> or <2>, wherein the discharge step is implemented when voltage of the electrolyzer falls below a specific threshold value in the suspension step.

<4> The method of operating an electrolysis apparatus according to any one of <1> to <3>, wherein the electrolyzer of the electrolysis apparatus is a bipolar electrolyzer and includes a plurality of electrolytic cells that each include one of the anode compartment and one of the cathode compartment, and the discharge step is implemented for a portion of the plurality of electrolytic cells.

<5> The method of operating an electrolysis apparatus according to any one of <1> to <4>, wherein the electrolyzer of the electrolysis apparatus is a bipolar electrolyzer and includes 30 or more electrolytic cells that each include one of the anode compartment and one of the cathode compartment.

<6> The method of operating an electrolysis apparatus according to any one of <1> to <5>, wherein retained electrical charge of the cathode is 0.1 times or less retained electrical charge of the anode.

The primary features of aspect (II) of the present disclosure are as follows.

<7> An electrolysis apparatus comprising an anode compartment including an anode and a cathode compartment including a cathode and having the anode compartment and the cathode compartment partitioned from each other by a membrane, wherein at least part of the cathode is present further upward in a vertical direction than an uncovered upper end of the membrane.

<8> The electrolysis apparatus according to <7>, wherein the cathode includes a main cathode part and an auxiliary cathode part that is connected to the main cathode part by a conductor, and at least part of the auxiliary cathode part is present further upward in the vertical direction than the uncovered upper end of the membrane.

<9> The electrolysis apparatus according to <7> or <8>, wherein a surface of the membrane is covered by a covering material such that a vertical direction lower end of the covering material constitutes the uncovered upper end of the membrane.

<10> The electrolysis apparatus according to any one of <7> to <9>, wherein an electrolyzer of the electrolysis apparatus includes a liquid level gauge that can measure a liquid surface in an electrode compartment of the electrolyzer.

Advantageous Effect

According to the present disclosure, it is possible to inhibit electrode degradation under a variable power supply.

In particular, in aspect (I) of the present disclosure, it is possible to provide a method of operating an electrolysis apparatus that can inhibit electrode degradation under a variable power supply. Moreover, according to aspect (II) of the present disclosure, it is possible to provide an electrolysis apparatus that can inhibit cathode degradation under a variable power supply and can also inhibit gas diffusion and mixing between electrode compartments via a membrane.

DETAILED DESCRIPTION

The following provides a detailed description of an embodiment of the present disclosure (hereinafter, referred to as the "present embodiment"). However, the present disclosure is not limited to the following embodiment and may be implemented with various alterations that are within the essential scope thereof. In the present embodiment, an embodiment of aspect (I) of the present disclosure is also referred to as present embodiment (I) and an embodiment of aspect (II) of the present disclosure is also referred to as present embodiment (II) in the present specification.

Figure 1:
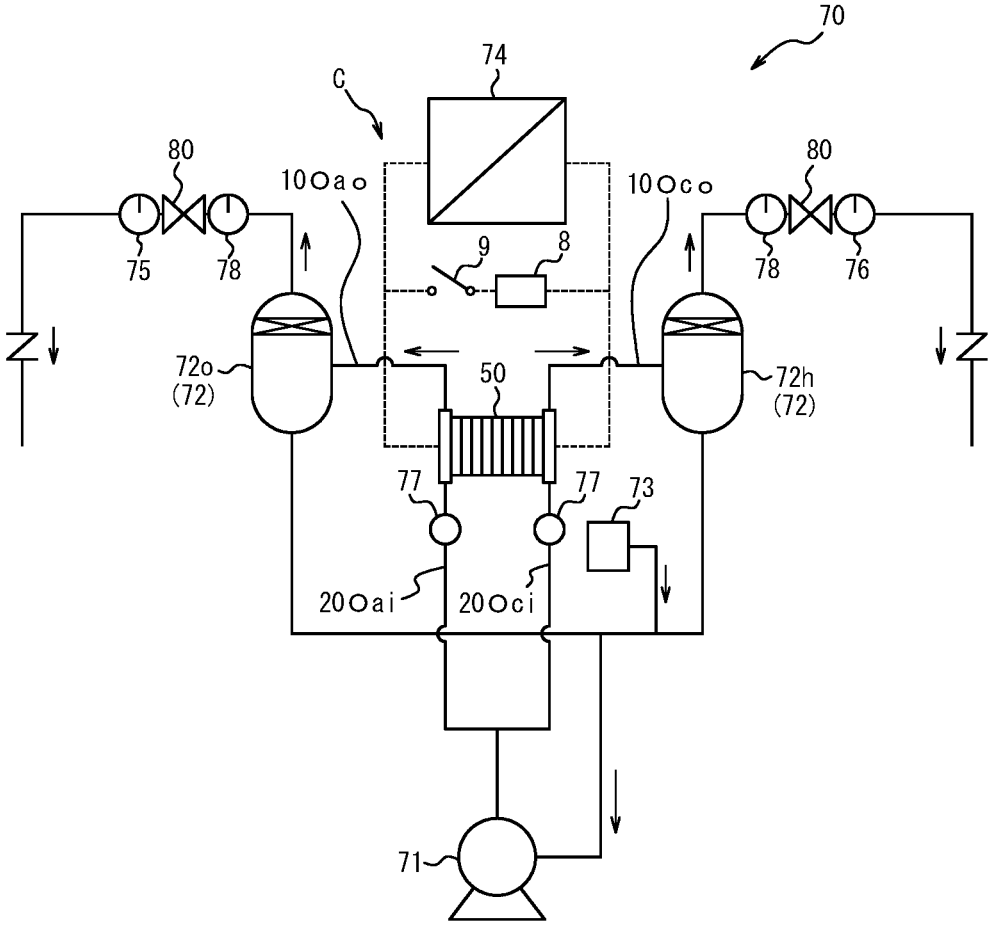
FIG. 1 is an overview of an electrolysis apparatus that can be used in a method of operating an electrolysis apparatus of a present embodiment.

FIG. 1 is an overview of an electrolysis apparatus that can be used in a method of operating an electrolysis apparatus of the present embodiment and also of an electrolysis apparatus of the present embodiment.

(Electrolysis Apparatus)

The electrolysis apparatus 70 includes an electrolyzer 50, a pump 71 for circulating electrolyte, a gas-liquid separation tank 72 for separating electrolyte from hydrogen and/or oxygen, and a water replenisher 73 for replenishing water consumed by electrolysis, for example, as illustrated in FIG. 1. More specifically, the electrolysis apparatus 70 of the present embodiment includes an anode compartment 5*a* that includes an anode 2*a* and a cathode compartment 5*c* that includes a cathode 2*c* and has the anode compartment 5*a* and the cathode compartment 5*c* partitioned from each other by a membrane 4.

Moreover, at least part of the cathode 2*c* may be present further upward in a vertical direction than an uncovered upper end 4*t* of the membrane 4, and this electrolysis apparatus makes it possible to inhibit degradation of the cathode 2*c* under a variable power supply and to inhibit gas diffusion and mixing between the electrode compartments 5 via the membrane 4.

First, constituent elements of the electrolysis apparatus 70 are described focusing mainly on the electrolyzer 50.

(Electrolyzer)

Although the electrolyzer 50 in the electrolysis apparatus 70 may be a monopolar electrolyzer or a bipolar electrolyzer without any particular limitations, a bipolar electrolyzer is industrially preferable as illustrated in FIG. 1, etc.

The bipolar method is one method of connecting a large number of cells to a power supply and is a method in which a plurality of bipolar elements 60 each having an anode 2*a* as one surface and a cathode 2*c* as one surface are arranged in the same orientation and connected in series, and then only both ends thereof are connected to a power supply.

A bipolar electrolyzer 50 has a feature of enabling a small power supply current and can be used to produce a large quantity of a compound, specific substance, or the like through electrolysis in a short time. Since power supply equipment having fixed current and high voltage is cheaper and more compact when power supply equipment having the same power is compared, the bipolar method is more industrially preferable than the monopolar method.

Figure 2:
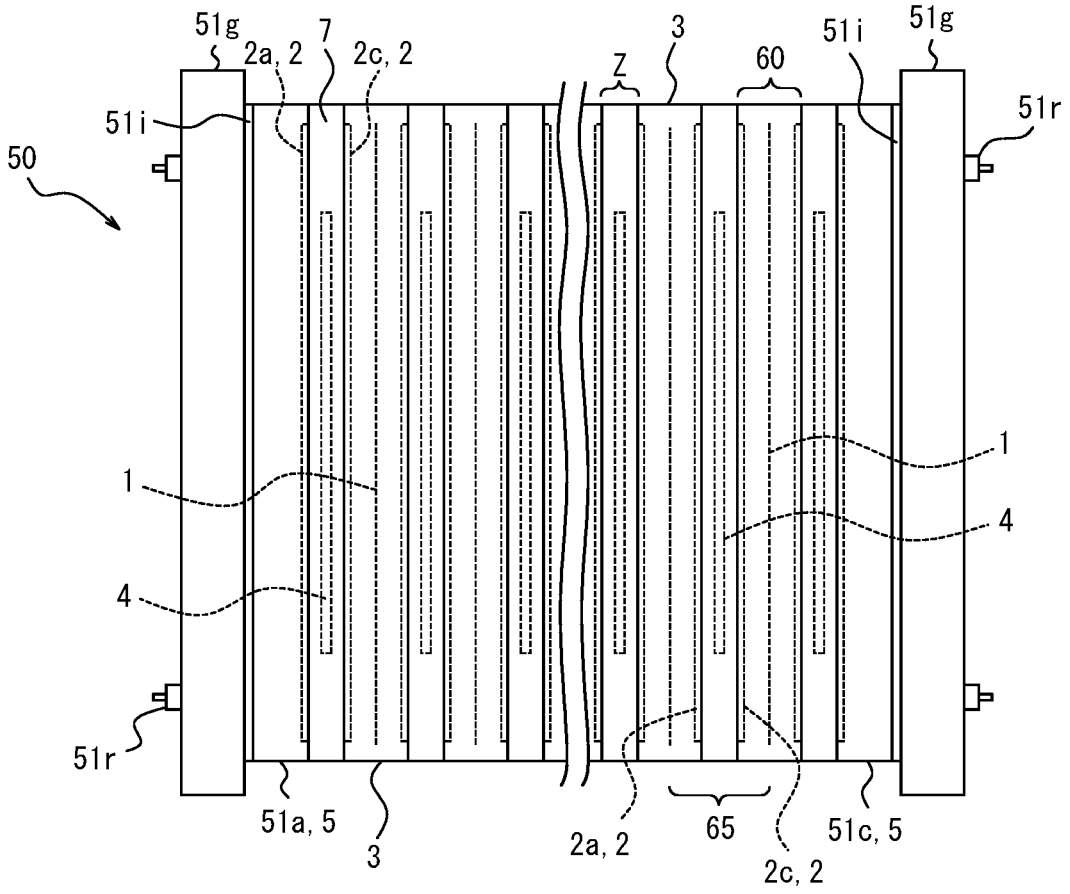
FIG. 2 is a side view illustrating the entirety of one example of an electrolyzer of the electrolysis apparatus illustrated in FIG. 1.

The bipolar electrolyzer 50 of the electrolysis apparatus 70 is a bipolar electrolyzer 50 in which a plurality of bipolar elements 60 that each include an anode 2*a*, a cathode 2*c*, a partition wall 1 separating the anode 2*a* and the cathode 2*c* from each other, and an outer frame 3 bordering the partition wall 1 are stacked with membranes 4 interposed therebetween as illustrated in FIG. 2.

((Bipolar Elements))

One example of a bipolar element 60 used in the bipolar electrolyzer 50 of the electrolysis apparatus 70 includes a partition wall 1 separating an anode 2*a* and a cathode 2*c* from each other and also includes an outer frame 3 bordering the partition wall 1 as illustrated in FIG. 2. More specifically, the partition wall 1 is electrically conductive and the outer frame 3 runs along the periphery of the partition wall 1 such as to border the partition wall 1.

Figure 3:
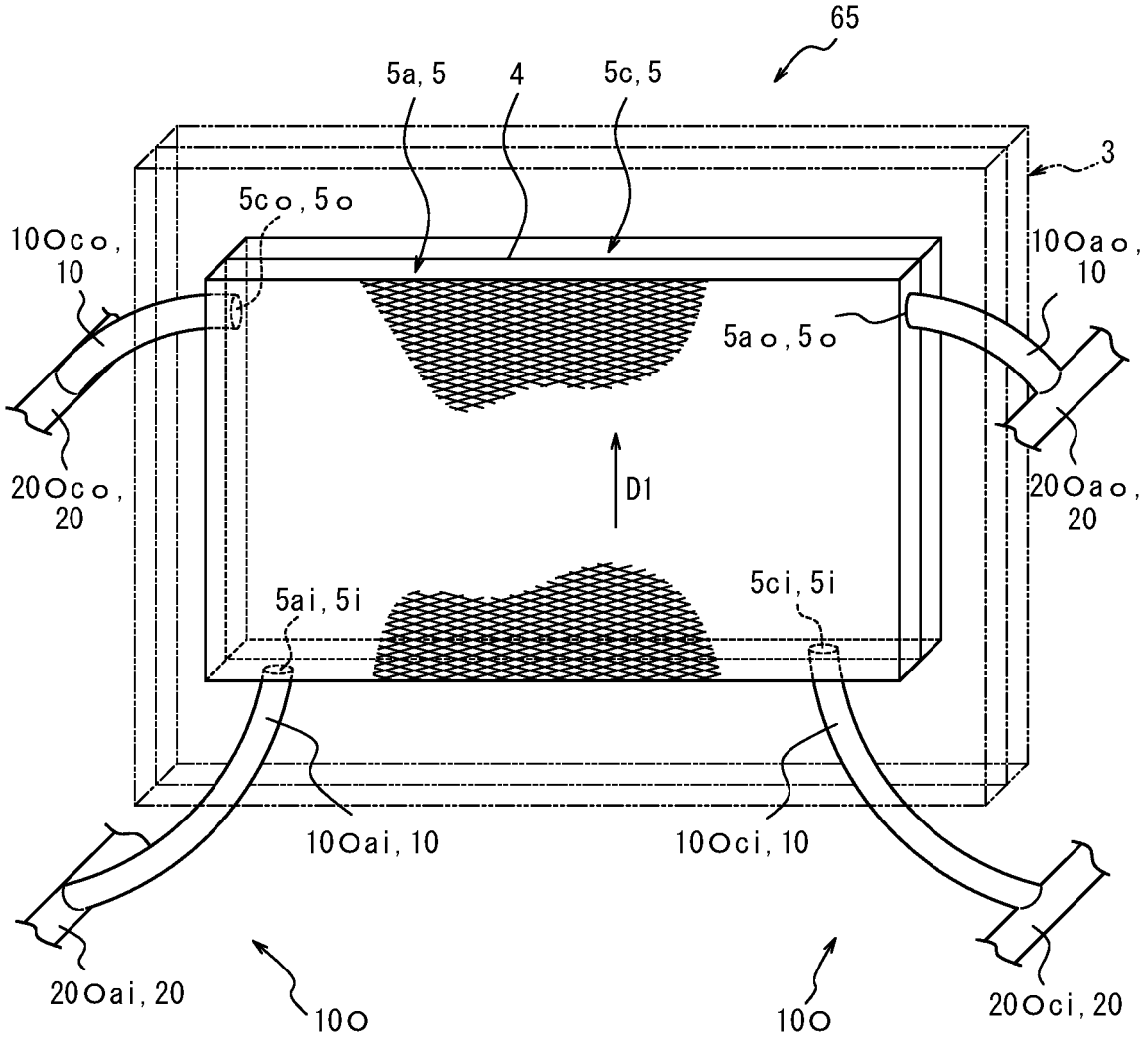
FIG. 3 is a perspective view illustrating electrolysis compartments, headers, and conduits of an external header-type electrolyzer that is one example of the electrolyzer of the electrolysis apparatus illustrated in FIG. 1.
Figure 4:
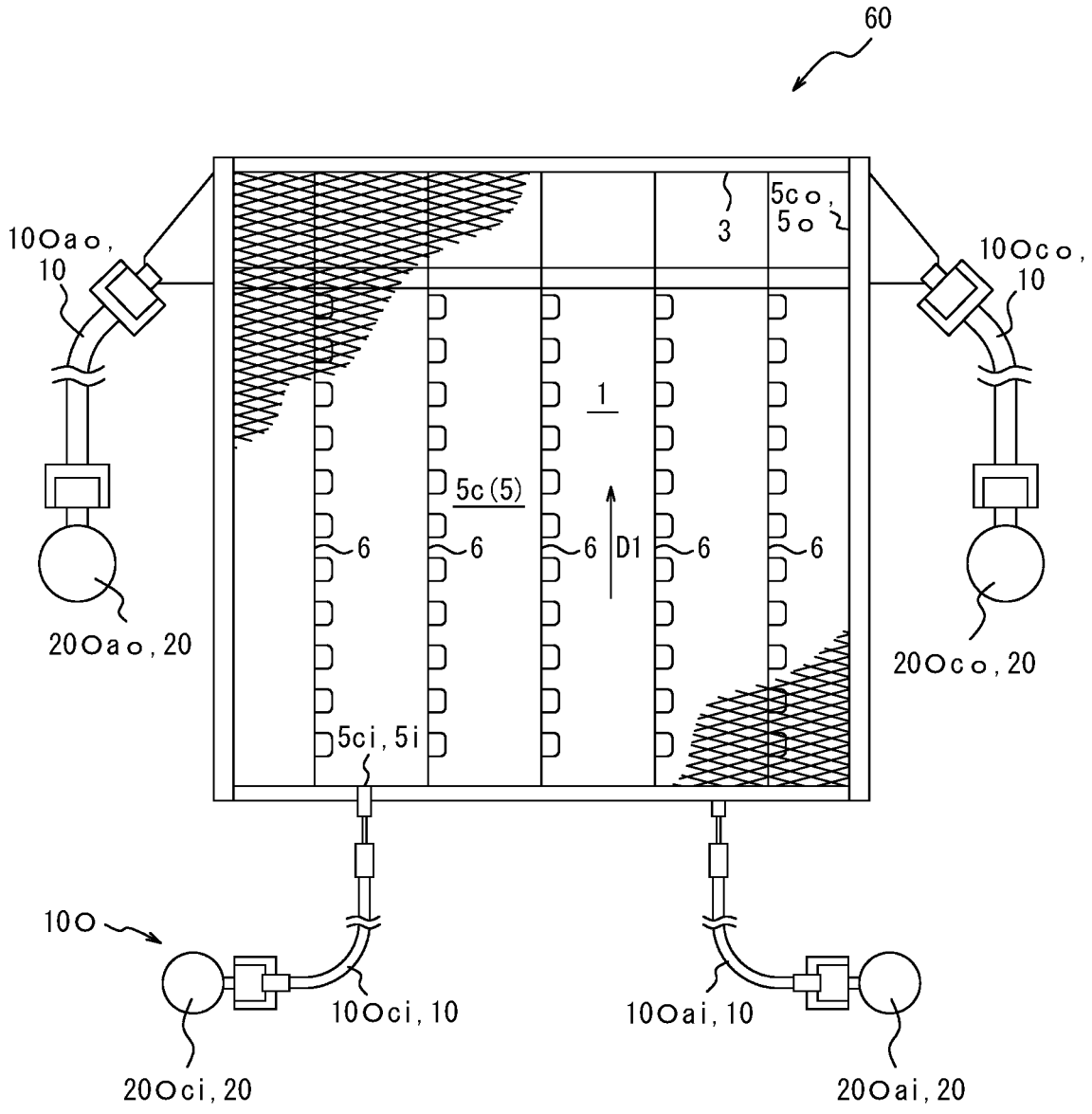
FIG. 4 is a plan view illustrating an external header-type electrolyzer that is one example of the electrolyzer of the electrolysis apparatus illustrated in FIG. 1.

Note that in the electrolysis apparatus 70, the bipolar element 60 may typically be used such that a given direction D1 along the partition wall 1 is a vertical direction. More specifically, in a case in which the partition wall 1 has a rectangular shape in plan view as illustrated in FIGS. 3 and 4, the bipolar element 60 may be used such that the given direction D1 along the partition wall 1 is the same direction as one pair of facing edges among the two pairs of facing edges of the partition wall 1 (refer to FIGS. 2 and 3).

The bipolar electrolyzer 50 is constructed by stacking the required number of bipolar elements 60 as illustrated in FIG. 2.

In the example illustrated in FIG. 2, the bipolar electrolyzer 50 includes, from one end thereof, a fast head 51*g*, an insulating plate 51*i*, and an anode terminal element 51*a* that are arranged in order, and further includes an anode-side gasket part 7, a membrane 4, a cathode-side gasket part 7, and a bipolar element 60 that are arranged in this order. In this case, the bipolar element 60 is arranged such that the cathode 2*c* thereof faces toward the anode terminal element 51*a*. Components from the anode-side gasket part 7 up to the bipolar element 60 are repeatedly arranged as many times as required for the designed production quantity. After components from the anode-side gasket part 7 up to the bipolar element 60 have been arranged repeatedly the required number of times, an anode-side gasket part 7, a membrane 4, and a cathode-side gasket part 7 are arranged again, and finally a cathode terminal element 51*c*, an insulating plate 51*i*, and a loose head 51*g* are arranged in this order. All of these components are unified to obtain the bipolar electrolyzer 50 through tightening using a tightening mechanism such as a tie rod mechanism 51*r* (refer to FIG. 2) or a hydraulic cylinder mechanism.

The arrangement of the bipolar electrolyzer 50 can be arbitrarily selected from either the anode 2*a* side or the cathode 2*c* side and is not limited to the order set forth above.

As illustrated in FIG. 2, the bipolar elements 60 are arranged between the anode terminal element 51*a* and the cathode terminal element 51*c* in the bipolar electrolyzer 50. Membranes 4 are arranged between the anode terminal element 51*a* and a bipolar element 60, between bipolar elements 60 that are adjacent to each other, and between a bipolar element 60 and the cathode terminal element 51*c*, respectively.

In the bipolar electrolyzer 50, the partition walls 1, the outer frames 3, and the membranes 4 define electrode compartments 5 through which electrolyte passes as illustrated in FIGS. 3 and 4.

In particular, in the bipolar electrolyzer 50 of the present embodiment, a section between the partition walls 1 of two bipolar elements 60 that are adjacent to each other and a section between the partition walls 1 of a bipolar element 60 and a terminal element that are adjacent to each other are each referred to as an electrolytic cell 65. Each electrolytic cell 65 includes: a partition wall 1, an anode compartment 5*a*, and an anode 2*a* of one element; a membrane 4; and a cathode 2*c*, a cathode compartment 5*c*, and a partition wall 1 of the other element.

In more detail, each electrode compartment 5 has an electrolyte inlet 5*i* for introducing electrolyte into the electrode compartment 5 and an electrolyte outlet 5*o* for drawing electrolyte out of the electrode compartment 5 at the boundary with the outer frame 3. More specifically, each anode compartment 5*a* includes an anode electrolyte inlet 5*ai* for introducing electrolyte into the anode compartment 5*a* and an anode electrolyte outlet 5*ao* for drawing electrolyte out of the anode compartment 5*a*. Likewise, each cathode compartment 5*c* includes a cathode electrolyte inlet 5*ci* for introducing electrolyte into the cathode compartment 5*c* and a cathode electrolyte outlet 5*co* for drawing electrolyte out of the cathode compartment 5*c*.

An internal distributor for uniformly distributing electrolyte over the electrode surface inside the electrolyzer 50 may be included in each anode compartment 5*a* and cathode compartment 5*c*. Moreover, each of the electrode compartments 5 may include a baffle plate having a function of limiting liquid flow inside the electrolyzer 50. Furthermore, protrusions for creating Karman vortices may be included in the anode compartments 5*a* and cathode compartments 5*c* in order to equalize electrolyte concentration and temperature inside the electrolyzer 50 and in order to promote degassing of gas attached to electrodes 2 and membranes 4.

The bipolar electrolyzer 50 includes headers 10 that are disposed outside of the outer frames 3 and are in communication with the electrode compartments 5 (refer to FIGS. 3 and 4).

In the example illustrated in FIGS. 3 and 4, headers 10 that are pipes for distributing or collecting gas and/or electrolyte are attached to the bipolar electrolyzer 50. More specifically, the headers 10 include inlet headers by which electrolyte enters the electrode compartments 5 and outlet headers by which gas and electrolyte are withdrawn from the electrode compartments 5.

In one example, an anode inlet header 10Oai by which electrolyte enters an anode compartment 5*a* and a cathode inlet header 10Oci by which electrolyte enters a cathode compartment 5*c* are included downward of an outer frame 3 disposed at the periphery of a partition wall 1, and, in the same way, an anode outlet header 10Oao by which electrolyte leaves the anode compartment 5*a* and a cathode outlet header 10Oco by which electrolyte leaves the cathode compartment 5*c* are included sideward of the outer frame 3 disposed at the periphery of the partition wall 1.

Moreover, in one example, an inlet header and an outlet header are disposed facing each other in each anode compartment 5*a* or cathode compartment 5*c* with a central part of the electrode compartment 5 interposed therebetween.

Particularly in the bipolar electrolyzer 50 of this example, an external header 10O type, which is a type in which the bipolar electrolyzer 50 and the headers 10 are separate, is adopted.

FIG. 4 is a plan view illustrating one example of an electrolyzer of an external header-type electrolysis apparatus.

Representative examples of the arrangement configuration of the headers 10 attached to the bipolar electrolyzer illustrated in FIGS. 2 to 4 are an internal header type and an external header 10O type. Either type may be adopted in the present disclosure without any particular limitations.

In the example illustrated in FIGS. 3 and 4, conduits 20 that are pipes for collecting gas and/or electrolyte that are distributed or collected in the headers 10 are attached to the headers 10. Specifically, the conduits 20 include distribution pipes that are in communication with inlet headers and collection pipes that are in communication with outlet headers.

In one example, an anode distribution pipe 20Oai that is in communication with an anode inlet header 10Oai and a cathode distribution pipe 20Oci that is in communication with a cathode inlet header 10Oci are included downward of the outer frame 3, and, in the same way, an anode collection pipe 20Oao that is in communication with an anode outlet header 10Oao and a cathode collection pipe 20Oco that is in communication with a cathode outlet header 10Oco are included sideward of the outer frame 3.

From a viewpoint of water electrolysis efficiency, it is preferable that the inlet header and the outlet header are disposed at separated positions in each anode compartment 5*a* and cathode compartment 5*c*, and it is also preferable that the inlet header and the outlet header are disposed facing each another with a central part of the electrode compartment 5 interposed therebetween. Also, in a case in which the partition wall 1 has a rectangular shape in plan view as illustrated in FIGS. 3 and 4, it is preferable that the inlet header and the outlet header are disposed symmetrically relative to the center of the rectangle.

Although one of each of an anode inlet header 10Oai, a cathode inlet header 10Oci, an anode outlet header 10Oao, and a cathode outlet header 10Oco are normally provided for each of the electrode compartments 5 as illustrated in FIGS. 3 and 4, this is not a limitation and a plurality thereof may be provided for each of the electrode compartments 5.

Moreover, although one of each of an anode distribution pipe 20Oai, a cathode distribution pipe 20Oci, an anode collection pipe 20Oao, and a cathode collection pipe 20Oco are normally provided for each of the electrode compartments 5, this is not a limitation and these pipes may be shared by a plurality of the electrode compartments 5.

In the illustrated example, each electrode compartment 5 has a cuboid shape as a result of a partition wall 1 having a rectangular shape in plan view and a membrane 4 having a rectangular shape in plan view being arranged in parallel and as a result of an inner surface at a partition wall 1 side of a cuboid outer frame provided at the periphery of the partition wall 1 being perpendicular to the partition wall 1. However, the shape of each electrode compartment 5 in the present disclosure is not limited to the cuboid in the illustrated example. The shape of each electrode compartment 5 may be modified as appropriate depending on the shapes of the partition wall 1 and the membrane 4 in plan view, the angle between the inner surface at the partition wall 1 side of the outer frame 3 and the partition wall 1, and so forth, and may be any shape so long as the effects disclosed herein are obtained.

Although no particular limitations are placed on the positional relationship of electrode compartments 5 and headers 10, in a case in which the bipolar elements 60 are used in a manner such that the given direction D1 along the partition wall 1 is a vertical direction as illustrated in FIGS. 3 and 4, inlet headers may be disposed downward or sideward relative to the electrode compartments 5 (downward in the drawings), outlet headers may be disposed upward or sideward relative to the electrode compartments 5 (sideward in the drawings), distribution pipes in communication with the inlet headers may be disposed downward or sideward relative to the electrode compartments 5 (downward in the drawings), and collection pipes in communication with the outlet headers may be disposed upward or sideward relative to the electrode compartments 5 (sideward in the drawings) as illustrated in FIGS. 3 and 4.

No particular limitations are placed on the extension direction of each header 10.

Although no particular limitations are placed on the extension direction of each conduit 20, it is preferable that distribution pipes (anode distribution pipe 20Oai, cathode distribution pipe 20Oci) and collection pipes (anode collection pipe 20Oao, cathode collection pipe 20Oco) each extend in a direction perpendicular to the partition wall 1 as in the example illustrated in FIGS. 3 and 4 from a viewpoint of more easily obtaining the effects disclosed herein, and more preferable that all conduits 20 extend in a direction perpendicular to the partition wall 1.

The bipolar electrolyzer 50 of the electrolysis apparatus 70 may include a plurality of flow rectifying plates 6 that are disposed in parallel to the given direction D1 along each partition wall 1. These flow rectifying plates 6 are provided in order to reduce convection in the electrode compartments 5 caused by turbulent flow of gas/liquid inside the electrode compartments 5, and to inhibit a localized increase in electrolyte temperature.

The electrolyzer 50 of the electrolysis apparatus 70 preferably includes 29 to 500 bipolar elements 60, more preferably includes 50 to 500 bipolar elements 60, even more preferably includes 70 to 300 bipolar elements 60, and particularly preferably includes 100 to 200 bipolar elements 60.

The effect of leakage current on gas purity diminishes as the number of pairs decreases, whereas it becomes more difficult to uniformly distribute electrolyte to each electrolytic cell 65 as the number of pairs increases. When the number falls below the lower limit or exceeds the upper limit, it becomes difficult to achieve both an effect of reducing self-discharge that occurs when electric power supply is suspended and enabling electric control system stabilization and an effect of achieving high-efficiency electric power storage (specifically, reduction of pump power and reduction of leakage current).

Moreover, when the number of bipolar elements 60 (number of pairs) is excessively high, it may become difficult to produce the electrolyzer 50, and, in a situation in which a large number of bipolar elements 60 having poor production accuracy are stacked, seal surface pressure tends to become uneven, and leakage of electrolyte or gas may occur.

In the electrolysis apparatus 70, a plurality of elements 60 are preferably stacked with membranes 4 interposed therebetween in a state in which the elements 60 are electrically insulated from one another. As a result of the elements 60 being in an electrically insulated state from one another in this manner, it is possible to inhibit electrical charge that has accumulated in each of the elements 60 during an energization step (step in which electrolysis of electrolyte is performed) from influencing other elements 60 during a suspension step (step in which electrolysis of electrolyte is suspended).

Note that the state in which the plurality of elements 60 are electrically insulated from one another is, more specifically, preferably a state in which there is electrical insulation between the outer frames 3 of the elements 60 and can be achieved by increasing electrical insulation of the gaskets 7 disposed between the elements 60, for example. This electrical insulation is preferably an insulation resistance of 1 MΩ or more between the elements 60.

The bipolar electrolyzer 50 of the electrolysis apparatus 70 preferably includes 30 or more electrolytic cells 65, more preferably includes 100 or more electrolytic cells 65, and even more preferably include 150 to 200 electrolytic cells 65. In the case of an electrolysis apparatus 70 that includes a plurality of electrolytic cells 65, a reverse current that flows in each of the electrolytic cells 65 is comparatively large for electrolytic cells 65 located centrally and is comparatively small for electrolytic cells 65 located at the ends. Therefore, the subsequently described method of operating an electrolysis apparatus 70 of the present embodiment can suitably be adopted in a case in which 30 or more electrolytic cells 65 are included.

The following provides a detailed description of the electrolysis apparatus 70 focusing mainly on constituent elements of the bipolar electrolyzer 50.

The following also provides a detailed description of preferable forms for enhancing the effects disclosed herein.

—Partition Wall—

The shape of each partition wall 1 may be a plate-like shape having a specific thickness but is not particularly limited thereto.

Note that each partition wall 1 may normally be used in a manner such that the given direction D1 along the partition wall 1 is a vertical direction. Specifically, in a case in which the partition wall 1 has a rectangular shape in plan view as illustrated in FIGS. 3 and 4, the partition wall 1 may be used such that the given direction D1 along the partition wall 1 is the same direction as one pair of facing edges among the two pairs of facing edges thereof.

From a viewpoint of achieving uniform supply of electric power, each partition wall 1 is preferably made of a material having electrical conductivity, and from perspectives of alkali resistance and heat resistance, preferred materials include nickel, nickel alloy, mild steel, and nickel alloy plated with nickel.

—Electrodes—

In hydrogen production by alkaline water electrolysis, reduction of energy consumption, and specifically reduction of the bath voltage is an important issue. Since the bath voltage is largely dependent on the electrodes 2, the performance of both of the electrodes 2 is important.

Besides the voltage required for water electrolysis that is theoretically determined, the bath voltage of alkaline water electrolysis is split into the overvoltage of the anode reaction (oxygen evolution), the overvoltage of the cathode reaction (hydrogen evolution), and the voltage due to the distance between the electrodes 2 (anode 2*a* and cathode 2*c*). The term "overvoltage" refers to the excess voltage that it is necessary to apply above the theoretical decomposition potential when passing a certain current, and the value thereof is dependent of the value of the current. The amount of electric power that is consumed can be reduced by using an electrode 2 having a lower overvoltage for when the same current is passed.

Requirements for an electrode 2 in order to display a low overvoltage include high electrical conductivity, high oxygen evolution capability (or hydrogen evolution capability), high wettability of electrolyte on the surface of the electrode 2, and so forth.

Other requirements for an electrode 2 used in alkaline water electrolysis besides having a low overvoltage are that corrosion of a substrate and a catalyst layer of the electrode 2, detachment of the catalyst layer, dissolution in electrolyte, attachment of contained substances to a membrane 4, and so forth should have a low tendency to occur even when an unstable current such as that of renewable energy is used.

Each electrode 2 is preferably a porous body since this can increase the surface area used in electrolysis and enables efficient removal of gas evolved through electrolysis from the surface of the electrode 2. Particularly in the case of a zero-gap electrolyzer, it is preferable that there is a through connection between a surface of the electrode 2 that is in contact with the membrane 4 and a surface at the opposite side of the electrode 2 because it is necessary for evolved gas to escape from the rear side relative to the contact surface with the membrane 4.

Examples of porous bodies that may be used include a plain weave mesh, a perforated metal, an expanded metal, and a metal foam.

A substrate may be used by itself as an electrode 2, or, alternatively, an electrode having a catalyst layer with high reaction activity on the surface of a substrate may be used. However, it is preferable to use an electrode having a catalyst layer with high reaction activity on the surface of a substrate.

Although the material of the substrate is not particularly limited, mild steel, stainless steel, nickel, and nickel-based alloys are preferable in terms of resistance to the operating environment.

The catalyst layer of each anode 2*a* preferably has high oxygen evolution capability. Nickel, cobalt, iron, a platinum group element, or the like can be used as the catalyst layer. In order to achieve the desired activity and durability, the catalyst layer may be formed by using any of these examples as a simple substance of metal, a compound such as an oxide, a complex oxide or alloy including a plurality of metal elements, or a mixture of any thereof. An organic substance such as a polymer may be included in order to improve durability and adhesiveness with the substrate.

The catalyst layer of each cathode 2*c* preferably has high hydrogen evolution capability. Nickel, cobalt, iron, a platinum group element, or the like can be used as the catalyst layer. In order to achieve the desired activity and durability, the catalyst layer may be formed by using any of these examples as a simple substance of metal, a compound such as an oxide, a complex oxide or alloy including a plurality of metal elements, or a mixture of any thereof. An organic substance such as a polymeric material may be included in order to improve durability and adhesiveness with the substrate.

Examples of methods by which the catalyst layer may be formed on the substrate include plating, thermal spraying such as plasma spraying, a thermal decomposition method in which a precursor layer solution is applied onto the substrate and is subsequently heated, a method in which a catalyst substance is mixed with a binder component and is then immobilized on the substrate, and vacuum film deposition such as sputtering.

—Outer Frame—

Although the shape of each outer frame 3 is not particularly limited as long as it can border the corresponding partition wall 1, the outer frame 3 may have a shape including an inner surface extending along an extension of the partition wall 1 in a direction perpendicular to the plane of the partition wall 1.

The shape of the outer frame 3 may be appropriately determined according to the shape of the partition wall 1 in plan view without any particular limitations.

The material of the outer frame 3 is preferably a material having electrical conductivity. From perspectives of alkali resistance and heat resistance, nickel, nickel alloy, mild steel, and nickel alloy plated with nickel are preferable.

—Membrane—

A membrane 4 displaying ion permeability is used as each membrane 4 in the bipolar electrolyzer 50 of the electrolysis apparatus 70 in order that evolved hydrogen gas and oxygen gas can be separated from each another while still conducting ions. This ion permeable membrane 4 may be an ion exchange membrane having ion exchange ability or a porous membrane through which electrolyte can permeate. The ion permeable membrane 4 preferably has low gas permeability, high ion conductivity, low electron conductivity, and high strength.

——Porous Membrane——

The porous membrane has a plurality of fine through-holes and has a structure that allows permeation of electrolyte through the membrane 4. Control of the porous structure in terms of pore diameter, porosity, and hydrophilicity is highly important for achieving ion conduction through permeation of the porous membrane by electrolyte. On the other hand, other than electrolyte, the porous membrane is required to not allow evolved gas to pass (i.e., display gas barrier properties). Control of the porous structure is also important from this viewpoint.

The porous membrane has a plurality of fine through-holes and may be a polymeric porous membrane, an inorganic porous membrane, a woven fabric, a nonwoven fabric, or the like, for example. These may be prepared by known techniques.

Examples of methods by which a polymeric porous membrane may be produced include a phase inversion method (microphase separation method), an extraction method, a drawing method, and a wet gel drawing method.

The porous membrane preferably contains a polymeric material and hydrophilic inorganic particles. The presence of hydrophilic inorganic particles can impart hydrophilicity to the porous membrane.

———Polymeric Material———

Examples of polymeric materials that may be used include polysulfone, polyethersulfone, polyphenylsulfone, polyvinylidene fluoride, polycarbonate, tetrafluoroethylene-perfluoroalkyl vinyl ether copolymer, tetrafluoroethylene-ethylene copolymer, polyvinylidene fluoride, polytetrafluoroethylene, perfluorosulfonic acid polymer, perfluorocarboxylic acid polymer, polyethylene, polypropylene, polyphenylene sulfide, poly(p-phenylenebenzobisoxazole), polyketone, polyimide, and polyetherimide. Of these polymeric materials, polysulfone, polyethersulfone, polyphenylsulfone, polyphenylene sulfide, and polytetrafluoroethylene are preferable, and polysulfone is more preferable. One of these polymeric materials may be used individually, or two or more of these polymeric materials may be used together.

The pore diameter of the porous membrane is preferably controlled in order to obtain appropriate membrane physical properties such as separation capability and strength. In the case of use in alkaline water electrolysis, the pore diameter of the porous membrane is preferably controlled from a viewpoint of preventing mixing of oxygen gas evolved from the anode 2*a* and hydrogen gas evolved from the cathode 2*c* and from a viewpoint of reducing voltage loss in electrolysis.

When the porous membrane has a larger average pore diameter, the amount of permeation through the porous membrane per unit area tends to increase, and, in particular, ion permeability of the porous membrane in electrolysis tends to be better, and reduction of voltage loss tends to be easier. Moreover, when the porous membrane has a larger average pore diameter, degradation of polymer tends to be inhibited because the contact surface area with alkaline water decreases.

On the other hand, when the porous membrane has a smaller average pore diameter, separation accuracy of the porous membrane tends to increase, and gas barrier properties of the porous membrane in electrolysis tend to be better. Moreover, in a case in which hydrophilic inorganic particles having a small particle diameter such as subsequently described are mounted on the porous membrane, these hydrophilic inorganic particles can be securely held without detachment. This can impart high holding ability of the hydrophilic inorganic particles and can maintain the effect of the hydrophilic inorganic particles over a long period.

From these viewpoints, the average pore diameter in the porous membrane is preferably within a range of not less than 0.1 μm and not more than 1.0 μm. When the pore diameter of the porous membrane is within this range, the porous membrane can have a balance of both excellent gas barrier properties and high ion permeability. The pore diameter of the porous membrane is preferably controlled in a temperature region in which the porous membrane is actually used. Accordingly, in a case in which the porous membrane is to be used as a membrane 4 for electrolysis in a 90° C. environment, for example, the pore diameter range set forth above is preferably satisfied at 90° C. The porous membrane more preferably has an average pore diameter of not less than 0.1 μm and not more than 0.5 μm as a range in which even better gas barrier properties and higher ion permeability can be achieved as a membrane 4 for alkaline water electrolysis.

The average pore diameter of the porous membrane can be measured by the following method.

The average pore diameter of the porous membrane is the average water permeation pore diameter measured by the following method using an integrity tester (Sartocheck Junior BP-Plus produced by Sartorius Stedim Japan K.K.). First, the porous membrane, inclusive of a core material, is cut out as a specific size to obtain a sample. The sample is set in an arbitrary pressure-resistant vessel that is then filled with pure water. Next, the pressure-resistant vessel is held inside a thermostatic tank that is set to a specific temperature, and measurement is commenced once the inside of the pressure-resistant vessel has reached the specific temperature. When measurement starts, values for pressure and permeation flow rate are recorded for when an upper surface side of the sample is pressurized with nitrogen and pure water permeates from a lower surface side of the sample. The average water permeation pore diameter can then be determined from the Hagen-Poiseuille equation, shown below, using the gradient of the pressure and the water permeation flow rate between pressures of 10 kPa and 30 kPa.

$$\text{Average water permeation pore diameter(m)} = \{32\eta L\mu_0/(\varepsilon P)\}^{0.5}$$

In this equation, η is the viscosity (Pa·s) of water, L is the thickness (m) of the porous membrane, $\mu_0$ is the apparent flow rate, and $\mu_0$ (m/s)=flow rate ($m^3$/s)/flow path area ($m^2$). Moreover, ε is the void fraction and P is the pressure (Pa).

In the case of a membrane 4 for alkaline water electrolysis, the porosity of the porous membrane is preferably controlled from viewpoints of gas barrier properties, maintenance of hydrophilicity, prevention of ion permeability reduction caused by attachment of bubbles, and achieving electrolysis performance (low voltage loss, etc.) that is stable over a long period.

The lower limit for the porosity of the porous membrane is preferably 30% or more, more preferably 35% or more, and even more preferably 40% or more from a viewpoint of achieving a balance of high levels of gas barrier properties, low voltage loss, and so forth. The upper limit for the porosity is preferably 70% or less, more preferably 65% or less, and even more preferably 55% or less. When the porosity of the porous membrane is not more than any of the upper limits set forth above, ions more easily permeate inside the membrane and voltage loss of the membrane can be suppressed.

The porosity of the porous membrane is the open porosity determined by the Archimedes method and can be determined by the following equation.

$$\text{Porosity } P(\%) = \rho/(1+\rho)\times 100$$

In this equation, ρ=(W3−W1)/(W3−W2), where W1 is the dry mass (g) of the porous membrane, W2 is the mass (g) in water of the porous membrane, and W3 is the water-saturated mass (g) of the porous membrane.

In the measurement method of porosity, three pieces of 3 cm×3 cm in size are cut out from a porous membrane that has been washed with pure water to obtain measurement samples. First, W2 and W3 of each of the samples are measured. Thereafter, the porous membrane is left at rest for at least 12 hours in a dryer set to 50° C. so as to dry the porous membrane, and then W1 is measured. The porosity is then determined from the values of W1, W2, and W3. The porosities of the three samples are determined, and the arithmetic mean of these values is taken to be the porosity P.

The thickness of the porous membrane is not particularly limited but is preferably not less than 100 μm and not more than 700 μm, more preferably not less than 100 μm and not more than 600 μm, and even more preferably not less than 200 μm and not more than 600 μm.

When the thickness of the porous membrane is not less than any of the lower limits set forth above, the porous membrane is harder to tear by piercing or the like and the occurrence of a short between electrodes becomes less likely. The porous membrane also has better gas barrier properties. Moreover, when the thickness is not more than any of the upper limits set forth above, voltage loss is less likely to increase. Moreover, the influence of unevenness of thickness of the porous membrane is reduced.

When the thickness of the membrane is 100 μm or more, the membrane is harder to tear by piercing or the like and the occurrence of a short between electrodes becomes less likely. The membrane also has better gas barrier properties. Voltage loss is less likely to increase when the thickness is 600 μm or less. Moreover, the influence of unevenness of thickness of the porous membrane is reduced.

When the thickness of the porous membrane is 250 μm or more, even better gas barrier properties are obtained, and the strength of the porous membrane against impact is further improved. From this viewpoint, the lower limit for the thickness of the porous membrane is more preferably 300 μm or more, even more preferably 350 μm or more, and further preferably 400 μm or more. On the other hand, when the thickness of the porous membrane is 700 μm or less, ion permeability is not easily impaired by resistance of electrolyte contained inside pores during operation, and even better ion permeability can be maintained. From this viewpoint, the upper limit for the thickness of the porous membrane is more preferably 600 μm or less, even more preferably 550 μm or less, and further preferably 500 μm or less.

———Hydrophilic Inorganic Particles———

The porous membrane preferably contains hydrophilic inorganic particles in order for it to display high ion permeability and high gas barrier properties. The hydrophilic inorganic particles may be attached to the surface of the porous membrane, or a portion of the hydrophilic inorganic particles may be embedded in the polymeric material that constitutes the porous membrane. When the hydrophilic inorganic particles are enclosed in voids in the porous membrane, it is difficult for the hydrophilic inorganic particles to detach from the porous membrane, and the performance of the porous membrane can be maintained for a long time.

The hydrophilic inorganic particles may be one or more inorganic substances selected from the group consisting of oxides and hydroxides of zirconium, bismuth, and cerium; oxides of elements belonging to group IV of the periodic table; nitrides of elements belonging to group IV of the periodic table; and carbides of elements belonging to group IV of the periodic table. Of these inorganic substances, oxides of zirconium, bismuth, and cerium, and oxides of elements belonging to group IV of the periodic table are more preferable, oxides of zirconium, bismuth, and cerium are even more preferable, and zirconium oxide is further preferable from a viewpoint of chemical stability.

The form of the hydrophilic inorganic particles is preferably a fine particulate form.

——Porous Support——

In a case in which a porous membrane is used as the membrane 4, the porous membrane may be used together with a porous support. A structure in which a porous membrane encloses a porous support is preferable, and a structure in which porous membranes are stacked at both sides of a porous support is more preferable. Moreover, a structure in which porous membranes are stacked symmetrically at both sides of a porous support may be adopted.

The porous support may be a mesh, a porous membrane, a nonwoven fabric, a woven fabric, a composite fabric including a nonwoven fabric and a woven fabric enclosed in the nonwoven fabric, or the like, for example. One of these types of porous supports may be used individually, or two or more of these types of porous supports may be used together. More preferable forms of the porous support include a mesh substrate composed of monofilaments of polyphenylene sulfide, a composite fabric including a nonwoven fabric and a woven fabric enclosed in the nonwoven fabric, and the like, for example.

——Ion Exchange Membrane——

Examples of ion exchange membranes that may be used include cation exchange membranes that allow selective permeation of cations and anion exchange membranes that allow selective permeation of anions. Either of these types of ion exchange membranes may be used.

Commonly known materials may be used as the material of the ion exchange membrane without any particular limitations. For example, a fluorine-containing resin or a modified resin of a polystyrene-divinylbenzene copolymer can suitably be used. In particular, a fluorine-containing ion exchange membrane is preferable due to excelling in terms of heat resistance, chemical resistance, and the like.

The fluorine-containing ion exchange membrane may be an ion exchange membrane that has a function of selectively passing ions produced during electrolysis and that contains a fluorine-containing polymer including an ion exchange group. The fluorine-containing polymer including an ion exchange group referred to herein is a fluorine-containing polymer that includes an ion exchange group or includes an ion exchange group precursor that can be converted to an ion exchange group through hydrolysis. For example, the fluorine-containing polymer may be a polymer that includes a fluorinated hydrocarbon main chain, that includes a functional group that can be converted to an ion exchange group through hydrolysis or the like in a pendant side chain, and that can be melt processed.

Although no particular limitations are placed on the molecular weight of the fluorine-containing copolymer, the value of the melt flow index (MFI) of the precursor as measured in accordance with ASTM:D1238 (measurement conditions: temperature 270° C., load 2160 g) is preferably 0.05 to 50 (g/10 min), and more preferably 0.1 to 30 (g/10 min).

The ion exchange group included in the ion exchange membrane may be a cation exchange group such as a sulfonic acid group, a carboxylic acid group, or a phosphoric acid group or may be an anion exchange group such as a quaternary ammonium group.

The ion exchange membrane can be provided with excellent ion exchange capability and hydrophilicity by adjusting the ion exchange group equivalent weight EW. Moreover, control can be performed so as to obtain a large number of smaller clusters (minute locations where water molecules are coordinated and/or adsorbed to ion exchange groups), and alkali resistance and ion selective permeability tend to improve.

The equivalent weight EW can be measured by performing salt substitution of the ion exchange membrane and then performing back titration of the resultant solution with an alkali or acid solution. The equivalent weight EW can be adjusted through the copolymerization ratio of monomers used as materials, selection of the types of monomers, and so forth.

The equivalent weight EW of the ion exchange membrane is preferably 300 or more from a viewpoint of hydrophilicity and membrane water resistance, and is preferably 1,300 or less from a viewpoint of hydrophilicity and ion exchange capability.

The thickness of the ion exchange membrane is not particularly limited but is preferably within a range of 5 μm to 300 μm from a viewpoint of ion permeability and strength.

Surface treatment may be performed with the object of improving hydrophilicity of the surface of the ion exchange membrane. More specifically, a method in which coating is performed with hydrophilic inorganic particles such as zirconium oxide or a method in which fine irregularities are imparted to the surface may be adopted.

The ion exchange membrane is preferably used together with a reinforcing material from a viewpoint of membrane strength. The reinforcing material is not particularly limited and may be a typical nonwoven fabric or woven fabric or a porous membrane formed of any of various materials. The porous membrane in this case is preferably a PTFE-based membrane that has been drawn so as to induce porosity, but is not particularly limited thereto.

((Zero-Gap Structure))

In each bipolar element 60 of a zero-gap cell, it is preferable to adopt a configuration in which a spring (elastic body) is disposed between an electrode 2 and a partition wall 1 and in which the electrode 2 is supported by the spring as a means of reducing inter-electrode distance. For instance, in a first example, a spring made of a conductive material may be attached to the partition wall 1, and the electrode 2 may be attached to the spring. In a second example, a spring may be attached to electrode ribs that are attached to the partition wall 1, and the electrode 2 may be attached to the spring. When adopting such a configuration using an elastic body, it is necessary to appropriately adjust the strength of the spring, the number of springs, the shape, and the like, as necessary, so as not to introduce non-uniformity in the pressure of the electrode 2 against the membrane 4.

—Electrode Compartments—

In the bipolar electrolyzer 50, the partition walls 1, outer frames 3, and membranes 4 define electrode compartments 5 through which electrolyte passes as illustrated in FIG. 3.

In the present embodiment, an internal header type or an external header 10O type can be adopted as the arrangement configuration of the headers 10 of the bipolar electrolyzer. For example, in the illustrated example, spaces occupied by an anode 2*a* and a cathode 2*c* themselves may be spaces inside the respective electrode compartments 5. Moreover, particularly in a case in which a gas-liquid separation box is provided, space occupied by the gas-liquid separation box may also be space inside an electrode compartment 5.

—Flow Rectifying Plates—

In the bipolar electrolyzer 50 of the electrolysis apparatus 70, it is preferable that flow rectifying plates 6 (anode flow rectifying plates 6*a* and cathode flow rectifying plates 6*c*) are attached to each partition wall 1, and that the flow rectifying plates 6 are each physically connected to the corresponding electrode 2. With this configuration, the flow rectifying plates 6 serve as supports for the electrodes 2, making it easier to maintain the zero-gap structure Z.

The flow rectifying plates 6 may have an electrode 2 disposed thereon or may have a current collector 2*r*, a conductive elastic body 2*e*, and an electrode 2 disposed thereon in this order.

In the previously described example of the bipolar electrolyzer 50 of the electrolysis apparatus 70, a structure in which flow rectifying plates 6, a current collector 2*r*, a conductive elastic body 2*e*, and an electrode 2 are stacked in this order is adopted in each cathode compartment 5*c*, whereas a structure in which flow rectifying plates 6 and an electrode 2 are stacked in this order is adopted in each anode compartment 5*a*.

Note that although a "flow rectifying plates 6/current collector 2*r*/conductive elastic body 2*e*/electrode 2" structure is adopted in each cathode compartment 5*c* and a "flow rectifying plates 6/electrode 2" structure is adopted in each anode compartment 5*a* in the previously described example of the bipolar electrolyzer 50 of the electrolysis apparatus 70, this is not a limitation in the present disclosure and a "flow rectifying plates 6/current collector 2*r*/conductive elastic body 2*e*/electrode 2" structure may also be adopted in each anode compartment 5*a*.

The flow rectifying plates 6 (anode flow rectifying plates 6*a* and cathode flow rectifying plates 6*c*) preferably have a role of transmitting current from the partition wall 1 to the anode 2*a* or cathode 2*c* in addition to having a role of supporting the anode 2*a* or cathode 2*c*.

In the bipolar electrolyzer 50 of the electrolysis apparatus 70, it is preferable that at least part of the flow rectifying plates 6 is electrically conductive, and more preferable that the whole of the flow rectifying plates 6 is electrically conductive. This configuration can inhibit a rise in cell voltage due to electrode deflection.

A conductive metal is typically used as the material of the flow rectifying plates 6. For example, nickel-plated mild steel, stainless steel, nickel, or the like may be used.

The gap between adjacent anode flow rectifying plates 6*a* or the gap between adjacent cathode flow rectifying plates 6*c* is set in consideration of the electrolysis potential, the pressure difference between an anode compartment 5*a* and a cathode compartment 5*c*, and so forth.

The length of the flow rectifying plates 6 (anode flow rectifying plates 6*a* and cathode flow rectifying plates 6*c*) may be set as appropriate depending on the size of the partition walls 1.

The height of the flow rectifying plates 6 may be set as appropriate depending on the distance to each flange part from a partition wall 1, the thickness of a gasket 7, the thickness of an electrode 2 (anode 2*a* or cathode 2*c*), the distance between an anode 2*a* and a cathode 2*c*, and so forth. The thickness of the flow rectifying plates 6 may be set as 0.5 mm to 5 mm in order to take into account cost, producibility, strength, and so forth. Flow rectifying plates 6 having a thickness of 1 mm to 2 mm are easy to use, but no particular limitations are made.

—Gaskets—

In the bipolar electrolyzer 50 of the electrolysis apparatus 70, it is preferable that gaskets 7 including the membranes 4 are sandwiched between the outer frames 3 bordering the partition walls 1.

Each of the gaskets 7 is used for providing a seal against electrolyte and evolved gas between each of the bipolar elements 60 and the membrane 4 and between the bipolar elements 60, and can prevent leakage of electrolyte and evolved gas to the outside of the electrolyzer and gas mixing between the electrode compartments.

The typical structure of the gasket 7 is that of a quadrilateral or annular shape from which an electrode surface is hollowed out in accordance with a surface in contact with the frame of an element. A membrane 4 can be stacked between elements in a form in which the membrane 4 is sandwiched between two gaskets such as described above. Moreover, it is preferable that the gasket 7 has a slit for housing the membrane 4 such that the membrane 4 can be held thereby and that the gasket 7 has an opening such that the housed membrane 4 can be exposed at both surfaces of the gasket 7. As a result, the gasket 7 has a structure in which it houses the periphery of the membrane 4 in the slit and covers an end surface at the periphery of the membrane 4. This can more reliably prevent leakage of electrolyte and gas from the end surface of the membrane 4.

The material of the gasket 7 is not particularly limited, and a commonly known rubber material, resin material, or the like that is an electrical insulator may be selected.

Specific examples of such rubber materials and resin materials include: rubber materials such as natural rubber (NR), styrene butadiene rubber (SBR), chloroprene rubber (CR), butadiene rubber (BR), acrylonitrile-butadiene rubber (NBR), silicone rubber (SR), ethylene-propylene rubber (EPT), ethylene-propylene-diene rubber (EPDM), fluororubber (FR), isobutylene-isoprene rubber (IIR), urethane rubber (UR), and chlorosulfonated polyethylene rubber (CSM); fluororesin materials such as polytetrafluoroethylene (PTFE), tetrafluoroethylene-perfluoroalkyl vinyl ether copolymer (PFA), tetrafluoroethylene-ethylene copolymer (ETFE), and chlorotrifluoroethylene-ethylene copolymer (ECTFE); and other resin materials such as polyphenylene sulfide (PPS), polyethylene, polyimide, and polyacetal. Of these materials, ethylene-propylene-diene rubber (EPDM) and fluororubber (FR) are particularly suitable from viewpoints of elastic modulus and alkali resistance.

The gasket 7 may have a reinforcing material embedded therein. This can inhibit squashing of the gasket 7 and can make it easier to prevent damage of the gasket 7 when the gasket 7 is sandwiched by frames and pressed during stacking.

The reinforcing material can be a commonly known metal material, resin material, carbon material, or the like. Specific examples of reinforcing materials that may be used include metals such as nickel and stainless steel, resins such as nylon, polypropylene, PVDF, PTFE, and PPS, and carbon materials such as carbon particles and carbon fiber.

The size of each gasket 7 may be designed in accordance with the dimensions of the electrode compartments 5 and the membranes without any particular limitations, and the width thereof may be set as 10 mm to 40 mm. In a case in which the gasket 7 includes a slit, the size of the slit may be set such that the internal dimensions of the slit are 0.5 mm to 5 mm larger than the membrane size both lengthwise and widthwise.

The thickness of the gasket 7 is designed in accordance with the material and elastic modulus of the gasket 7 and with the cell area without any particular limitations. In terms of preferable ranges for the thickness, a range of 1.0 mm to 10 mm is preferable, and a range of 3.0 mm to 10 mm is more preferable.

In a case in which the gasket 7 includes a slit, the opening width of the slit may be set as 0.5 times to 1.0 times the membrane thickness.

The elastic modulus of the gasket 7 is designed in accordance with materials of the electrodes 2 and the cell area without any particular limitations. In terms of preferable ranges for the elastic modulus, a range of 0.20 MPa to 20 MPa for tensile stress at 100% deformation is more preferable, and a range of 1.0 MPa to 10 MPa is more preferable from a viewpoint of sealing characteristics and cell strength during stacking.

Note that the tensile stress may be measured in accordance with HS K6251. For example, the tensile stress can be measured using an Autograph AG produced by Shimadzu Corporation.

In particular, it is preferable that the thickness of the gasket 7 is 3.0 mm to 10 mm and that the tensile stress at 100% deformation is 1.0 MPa to 10 MPa from a viewpoint of inhibiting an increase of cell voltage caused by electrode deflection and a viewpoint of sealing characteristics and cell strength during stacking.

In the electrolysis apparatus 70, the surface of each gasket 7 is preferably covered by a resin sheet that is an electrical insulator (for example, a fluororesin such as polytetrafluoroethylene, etc.). As a result of the plurality of elements 60 being in an electrically insulated state from one another through this configuration, it is possible to inhibit electrical charge that has accumulated in each of the elements 60 during an energization step (step in which electrolysis of electrolyte is performed) from influencing other elements 60 during a suspension step (step in which electrolysis of electrolyte is suspended).

—Header—

The bipolar electrolyzer 50 of the electrolysis apparatus 70 comprises a cathode compartment 5*c* and an anode compartment 5*a* for each electrolytic cell 65. In order to conduct an electrolysis reaction continuously in the electrolyzer 50, it is necessary to continuously supply electrolyte that contains a sufficient amount of material to be consumed by electrolysis into the cathode compartment 5*c* and the anode compartment 5*a* of each electrolytic cell 65.

Each electrolytic cell 65 is connected to electrolyte supply/discharge piping called headers 10, which are shared by a plurality of electrolytic cells 65. In general, an anode distribution pipe is called an anode inlet header 10*ai*, a cathode distribution pipe is called a cathode inlet header 10*ci*, an anode collection pipe is called an anode outlet header 10*ao*, and a cathode collection pipe is called a cathode outlet header 10*co*. The electrolytic cell 65 is connected to the distribution pipe for each electrode and the collection pipe for each electrode through a hose or the like.

Although the material of the headers 10 is not particularly limited, it is necessary to adopt a material that can sufficiently withstand corrosive properties of the electrolyte that is to be used and operating conditions such as pressure and temperature. The material of the headers 10 may be iron, nickel, cobalt, PTFE, ETFE, PFA, polyvinyl chloride, polyethylene, or the like.

The extent of each electrode compartment 5 varies depending on the detailed structure of the outer frame 3 disposed at the periphery of the partition wall 1, and the detailed structure of the outer frame 3 varies depending on the arrangement configuration of the headers 10 (pipes for electrolyte distribution/collection) attached to the outer frame 3. Representative examples of the arrangement configuration of the headers 10 of the bipolar electrolyzer 50 are an internal header 10I type and an external header 10O type.

—Internal Header—

The internal header type is a type in which the bipolar electrolyzer 50 and the headers 10 (pipes for electrolyte distribution/collection) have a unified structure.

More specifically, in an internal header-type bipolar electrolyzer 50, an anode inlet header and a cathode inlet header are disposed at a lower part inside the partition wall 1 and/or inside the outer frame 3 and are disposed such as to extend in a direction perpendicular to the partition wall 1, whereas an anode outlet header and a cathode outlet header are disposed at an upper part inside the partition wall 1 and/or inside the outer frame 3 and are disposed such as to extend in a direction perpendicular to the partition wall 1.

The anode inlet header, cathode inlet header, anode outlet header, and cathode outlet header that are included inside an internal header-type bipolar electrolyzer 50 are referred to collectively as internal headers.

In an example of the internal header type, the anode inlet header and the cathode inlet header are included in part of a lower part of the outer frame 3 disposed at the periphery of the partition wall 1, and, similarly, the anode outlet header and the cathode outlet header are included in part of an upper part of the outer frame 3 disposed at the periphery of the partition wall 1.

—External Header—

The external header 10O type is a type in which the bipolar electrolyzer 50 and the headers 10 (pipes for electrolyte distribution/collection) are separate.

In the case of an external header 10O type bipolar electrolyzer 50, an anode inlet header 10Oai and a cathode inlet header 10Oci are separately provided in a manner such as to run alongside the electrolyzer 50 in a direction perpendicular to the current-carrying surface of an electrolytic cell 65. The anode inlet header 10Oai and the cathode inlet header 10Oci are connected to each electrolytic cell 65 by a hose.

The anode inlet header 10Oai, cathode inlet header 10Oci, anode outlet header 10Oao, and cathode outlet header 10Oco that are externally connected to the external header 10O type bipolar electrolyzer 50 are collectively referred to as external headers 10O.

In an example of the external header 10O type, lumen-like members are provided at through-holes for the headers 10 in a lower part of the outer frame 3 disposed at the periphery of the partition wall 1, and these lumen-like members are connected to the anode inlet header 10Oai and the cathode inlet header 10Oci. Likewise, lumen-like members (for example, a hose or a tube) are provided at through-holes for the headers 10 in an upper part of the outer frame 3 disposed at the periphery of the partition wall 1, and these lumen-like members are connected to the anode outlet header 10Oao and the cathode outlet header 10Oco.

The bipolar electrolyzer 50 of the internal header 10I type or external header 10O type may include a gas-liquid separation box for separating electrolyte and gas that has evolved through electrolysis inside the bipolar electrolyzer 50. The installation position of the gas-liquid separation box is not particularly limited. For example, a gas-liquid separation box may be installed between the anode compartment 5*a* and the anode outlet header 10*ao* and/or between the cathode compartment 5*c* and the cathode outlet header 10*co*.

The surface of the gas-liquid separation box may be coated with a coating material that can sufficiently withstand corrosive properties of the electrolyte and operating conditions such as pressure and temperature. An electrically insulating material may be adopted as the coating material with the object of increasing electric resistance of a leakage current circuit inside the electrolyzer. For example, EPDM, PTFE, ETFE, PFA, polyvinyl chloride, polyethylene, or the like may be adopted as the coating material.

—Liquid Level Gauge—

The electrolyzer 50 of the electrolysis apparatus 70 may include a liquid level gauge that can measure the liquid surface inside each electrode compartment 5*a* or 5*c* of the electrolyzer 50. In particular, the inclusion of a liquid level gauge is preferable in present embodiment (II). The liquid level gauge makes it possible to monitor the liquid surface inside each electrode compartment 5*a* or 5*c* (monitor the height of the liquid surface inside each electrode compartment 5*a* or 5*c*) and to determine whether the surface of the membrane 4 is in an immersed state in electrolyte inside each electrode compartment 5*a* or 5*c* or whether the surface of the membrane 4 is in a non-immersed state.

A direct viewing, contact, or pressure difference type liquid level gauge, for example, can be used as the liquid level gauge without any particular limitations.

(First Cathode Protector)

The electrolysis apparatus 70 may include a first cathode protector that can electrically insulate a supply path and/or discharge path from a cathode compartment 5*c*. In particular, the inclusion of a first cathode protector is preferable in present embodiment (II). By electrically insulating a supply path and/or discharge path from a cathode compartment 5*c* through the first cathode protector during a suspension step, the overall amount of reverse current generated in the cathode 2*c* during the suspension step can be reduced. As a result, degradation of the cathode 2*c* under a variable power supply can be inhibited.

The first cathode protector may be implemented by providing a valve made of resin in a supply path and/or discharge path (more specifically, cathode distribution pipe 20Oci, cathode inlet header (cathode inlet hose) 10Oci, cathode collection pipe 20Oco, cathode outlet header (cathode outlet hose) 10Oco, etc.). The first cathode protector can also be implemented by positioning a supply path upward in a vertical direction relative to the cathode compartment 5*c* and positioning a discharge path upward in a vertical direction relative to the cathode compartment 5*c*. This configuration makes it possible for electrolyte to drop under its own weight to thereby form an electrically insulating gas layer in the supply path and/or discharge path when the pump 71 is suspended, for example, in a suspension step.

(Second Cathode Protector)

The electrolysis apparatus 70 may include a second cathode protector that can shut off an electrical circuit including the electrolyzer and an electrolysis power supply (rectifier) 74 that is formed in the electrolysis apparatus 70. In particular, the inclusion of a second cathode protector is preferable in present embodiment (II). By shutting off the electrical circuit through the second cathode protector in a suspension step, reverse current generated in a cathode 2*c* can be reduced.

Note that the second cathode protector may be a circuit breaker, a disconnector, a switch, or a diode that impedes current in a reverse direction in the electrical circuit.

(Positional Relationship of Upper Ends of Cathode and Membrane in Vertical Direction D1)

Figure 5A:
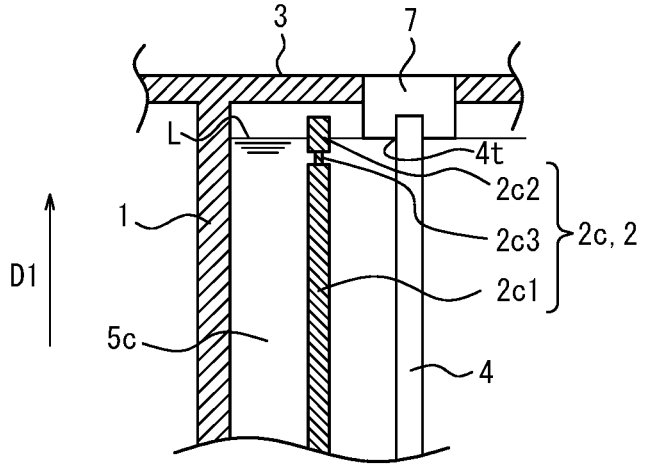
FIG. 5A is a cross-sectional view schematically illustrating a cross-section of a cathode compartment of one example of the electrolyzer of the electrolysis apparatus illustrated in FIG. 1 at a plane along a vertical direction and a direction perpendicular to a cathode and FIG. 5B is a plan view schematically illustrating the cathode compartment.
Figure 5B:
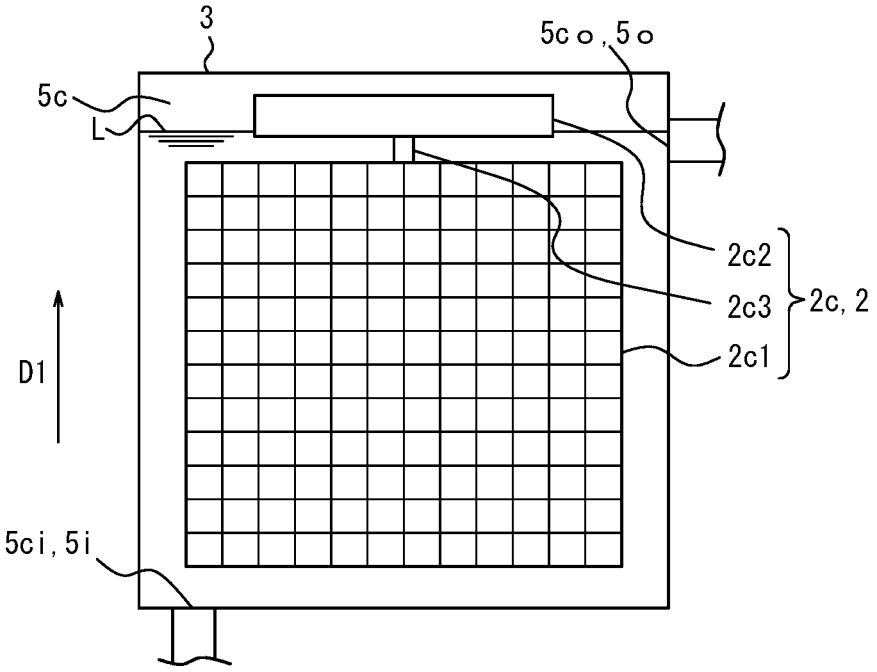
Figure 6:
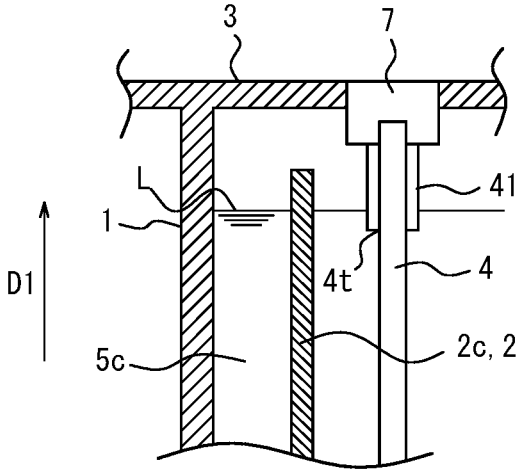
FIG. 6 is a cross-sectional view schematically illustrating a cross-section of a modified example of the cathode compartment illustrated in FIGS. 5A and 5B at a plane along a vertical direction and a direction perpendicular to the cathode.
Figure 7A:
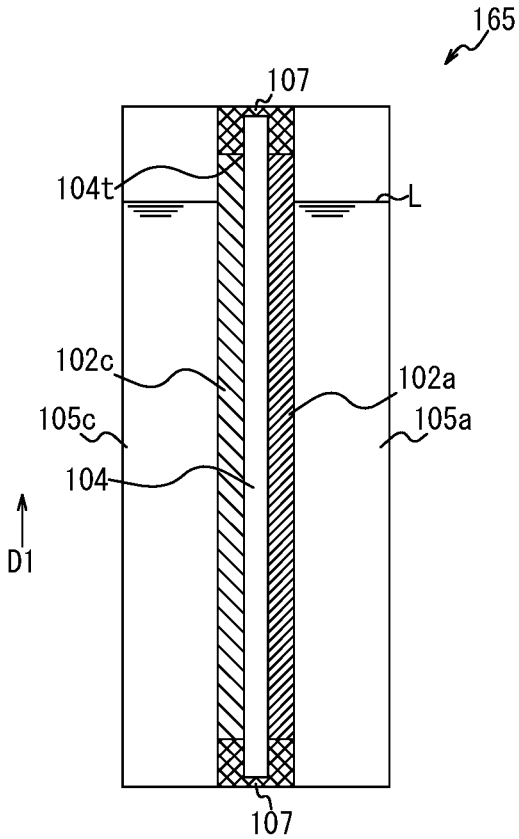
FIGS. 7A and 7B each illustrate an electrolytic cell of a conventional electrolysis apparatus.
Figure 7B:
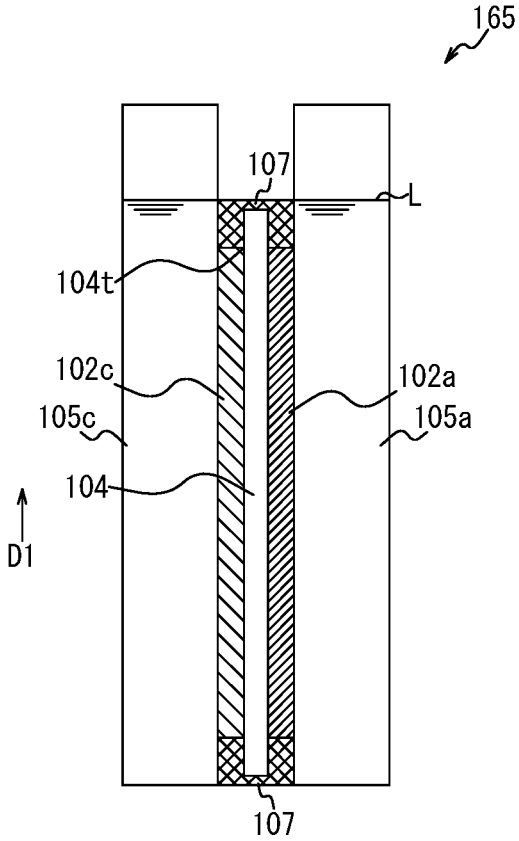

In the electrolysis apparatus 70, it is preferable that at least part of each cathode 2*c* is present further upward in the vertical direction D1 than an uncovered upper end 4*t* of the corresponding membrane 4. This makes it possible for the waterline L (liquid surface position) of electrolyte in each anode compartment 5*a* and/or cathode compartment 5*c* to be positioned further upward in a vertical direction than the uncovered upper end 4*t* of the membrane 4 while also causing at least part of the cathode 2*c* to be exposed to a hydrogen gas layer that can be present in the cathode compartment 5*c* as illustrated in FIGS. 5A, 5B, and 6 during a suspension step. As a result, it is possible to inhibit degradation of the cathode 2*c* while also inhibiting gas diffusion and mixing between electrode compartments 5*a* and 5*c* via the membrane while electrolysis is suspended.

More specifically, with regards to degradation of a cathode 2*c*, electrical charge that has accumulated in the cathode (and anode 2*a*) during an energization step causes the generation of a reverse current in the cathode 2*c* during a suspension step in conventional electrolysis apparatus operation. When this reverse current is generated, oxidation of the cathode itself may occur. (Note that a reduction reaction occurs in the cathode compartment during an energization step.) The repeated performance of energization steps and suspension steps may lead to degradation of the cathode 2*c*. In response to this issue, part of each cathode 2*c* is exposed to hydrogen gas upward of the waterline L as illustrated in FIGS. 5A, 5B, and 6 during a suspension step in the electrolysis apparatus of the present embodiment (particularly in present embodiment (II)). Therefore, even when a reverse current is generated in the cathode 2*c*, hydrogen that is in contact with the cathode 2*c* is oxidized, and thus oxidation of the cathode 2*c* itself can be reduced and degradation of the cathode 2*c* can be inhibited.

Moreover, with regards to inhibition of gas diffusion and mixing via a membrane 4, when both surfaces of a membrane 4 are exposed to gas in conventional electrolysis apparatus operation, gases in electrode compartments 5*a* and 5*c* pass slightly through the membrane 4 and diffuse in the electrode compartments 5*a* and 5*c*. However, in the electrolysis apparatus of the present embodiment, part of a cathode 2*c* can be exposed to hydrogen gas during a suspension step while also causing the waterline L (liquid surface position) of electrolyte in the anode compartment 5*a* and/or cathode compartment 5*c* to be positioned further upward in a vertical direction than an uncovered upper end 4*t* of the membrane 4 such that at least one surface of the membrane 4 is in an immersed state in liquid. Accordingly, gas diffusion and mixing between the electrode compartments 5*a* and 5*c* can be inhibited.

Note that the "uncovered upper end of the membrane" is the upper end of the membrane 4 in the vertical direction D1, or, in a case in which, for part of the membrane itself at an upper end side in the vertical direction D1, part of a surface of the membrane 4 is covered by a gasket or the like used to fix the membrane 4 in place between outer frames 3 of the electrolyzer 50 as illustrated in FIG. 5A or part of a surface of the membrane 4 is covered by a gasket 7 and also by a covering material 41 such as subsequently described as illustrated in FIG. 6, for example, the "uncovered upper end of the membrane" refers to the upper end in the vertical direction D1 for a part of the membrane 4 that is not covered by the gasket 7, the covering material 41, or the like.

More specifically, in such an electrolysis apparatus 70, a cathode 2*c* may comprise a main cathode part 2*c*1 and an auxiliary cathode part 2*c*2 that is connected to the main cathode part 2*c*1 by a conductor 2*c*3 as illustrated in FIGS. 5A and 5B, which schematically illustrate a cathode compartment 5*c*, and at least an upper part of the auxiliary cathode part 2*c*2 in the vertical direction D1 may be present further upward in the vertical direction D1 than an uncovered upper end 4*t* of a membrane 4 as illustrated in FIG. 5A. Through the inclusion of the auxiliary cathode part 2*c*2 in the cathode 2*c* in this manner, it is possible to, by setting the position of the waterline L of electrolyte as illustrated during a suspension step, cause oxidation of hydrogen gas by the auxiliary cathode part 2*c*2 to occur even when a reverse current is generated, and thereby prevent degradation of the cathode 2*c* while also preventing mixing of oxygen into hydrogen present in the cathode compartment 5*c* that can occur as a result of a surface of the membrane 4 being exposed to gas during the suspension step.

Note that the electrolysis apparatus 70 may alternatively have a configuration in which the cathode 2*c* is composed of only a main cathode part 2*c*1 rather than including an auxiliary cathode part 2*c*2 that is separated from the main cathode part 2*c*1, and in which the upper end of the main cathode part 2*c*1 in the vertical direction D1 is extended to the position of the upper end of the auxiliary cathode part 2*c*2 in the vertical direction D1 that is illustrated in FIG. 5A. However, the inclusion of the auxiliary cathode part 2*c*2 in the cathode 2*c* as illustrated in FIG. 5A makes it easier to replace the cathode 2*c* during maintenance compared to a case in which the auxiliary cathode part 2*c*2 is not included. Moreover, it is possible to reduce the overall size of the cathode 2*c* by using the auxiliary cathode part 2*c*2 and also to reduce the cost of the cathode 2*c* by, for example, reducing the electrolysis performance of the auxiliary cathode part 2*c*2 during an energization step as compared to that of the main cathode part 2*c*1 (for example, by reducing the amount of catalyst).

The main cathode part 2*c*1 is an electrode for performing electrolysis of electrolyte during an energization step in the same way as the cathode 2*c* in a case in which the auxiliary cathode part 2*c*2 is not included, and the structure and material thereof may be the same as for the cathode 2*c* in a case in which the auxiliary cathode part 2*c*2 is not included.

Moreover, the auxiliary cathode part 2*c*2 can be formed using any material that can be used to form the main cathode part 2*c*1 and can be the same material as the main cathode part 2*c*1 without any particular limitations so long as the auxiliary cathode part 2*c*2 can be in contact with and cause oxidation of hydrogen when a reverse current is generated. Furthermore, as illustrated in the schematic plan view of a cathode compartment 5*c* in FIG. 5B, the length in the vertical direction D1 and the length in a perpendicular direction to the vertical direction D1 of the auxiliary cathode part 2*c*2 are smaller than the length in a horizontal direction and the length in a perpendicular direction to the vertical direction D1 of the main cathode part 2*c*1. Although no particular limitations are placed on the specific dimensions so long as the auxiliary cathode part 2*c*2 is small enough to be housed in the cathode compartment 5*c* together with the main cathode part 2*c*1, the length in the vertical direction D1 of the auxiliary cathode part 2*c*2 is preferably 90 mm or less.

The conductor 2*c*3 connecting the main cathode part 2*c*1 and the auxiliary cathode part 2*c*2 can be formed using any material that can be used as a substrate of the cathode 2*c* and can be the same material as the main cathode part 2*c*1.

Note that although the example illustrated in FIG. 5A does not make use of a covering material 41 that covers a surface of the membrane 4 such as used in the example illustrated in FIG. 6, such a covering material 41 can also be used in the example illustrated in FIG. 5A.

Moreover, an electrolysis apparatus 70 illustrated in FIG. 6 may also preferably be adopted instead of the example illustrated in FIGS. 5A and 5B as an electrolysis apparatus 70 in which at least part of a cathode 2*c* is present further upward than an uncovered upper end 4*t* of a membrane 4. Specifically, the electrolysis apparatus 70 illustrated in FIG. 6 has a configuration in which a surface of the membrane 4 is covered by a covering material 41 such that a vertical direction lower end of the covering material 41 constitutes the uncovered upper end 4*t* of the membrane 4. More specifically, part of a surface of the membrane 4 is covered by the gasket 7 and also by the covering material 41 as described further below, which results in at least part of the cathode 2*c* being present further upward than the uncovered upper end 4*t* of the membrane 4. By adopting such a configuration, it is possible to achieve the same effects as with the electrolysis apparatus 70 illustrated in FIGS. 5A and 5B and also to simplify the structure of the cathode as compared to a case in which the cathode 2*c* includes an auxiliary cathode part 2*c*2 as illustrated in FIGS. 5A and 5B.

Polytetrafluoroethylene or the like may, for example, be used as the covering material 41, though no particular limitations are made so long as the covering material 41 can cover a surface of the membrane 4 and can prevent permeation of gas in the electrode compartments 5*a* and 5*c* that are partitioned from each other by the membrane 4 in a situation in which a part of the membrane 4 that is covered by the covering material 41 is present in gas.

Moreover, although the covering material 41 is provided at both surfaces of the membrane 4 in FIG. 6, the covering material 41 may be provided at just one surface of the membrane 4 so long as it is possible to prevent permeation of gas in the electrode compartments 5*a* and 5*c* that are partitioned from each other by the membrane 4 in a situation in which a part of the membrane 4 that is covered by the covering material 41 is present in gas. Note that in a case in which the vertical direction position of an uncovered upper end differs between a surface at one side of the membrane 4 and a surface at the other side of the membrane 4 in this manner and thus the covered range differs between the surface at one side and the surface at the other side, the uncovered upper end of a surface that is further downward in the vertical direction is taken to be the "uncovered upper end of the membrane".

In a case in which a covering material 41 is provided on a surface of the membrane 4, it is preferable that the surface is covered by the covering material 41 from an upper end of the membrane 4 (covered from a position adjacent to a lower end of a gasket or the like in a case in which the surface at an upper end side of the membrane 4 is covered by a gasket or the like) and that a lower end of the covering material 41 in the vertical direction D1 is positioned further downward in the vertical direction D1 than the position of the upper end of the cathode 2*c* in the vertical direction D1. Moreover, it is more preferable that the lower end of the covering material 41 in the vertical direction D1 is further downward in the vertical direction D1 than the position of the upper end of the cathode 2*c* in the vertical direction D1 and that the lower end of the covering material 41 in the vertical direction D1 is further upward in the vertical direction D1 than a position separated 20 mm downward in the vertical direction D1 from the position of the upper end of the cathode 2*c* in the vertical direction D1, and it is even more preferable that the lower end of the covering material 41 is further upward in the vertical direction D1 than a position separated 10 mm downward in the vertical direction D1 from the position of the upper end of the cathode 2*c* in the vertical direction D1.

Next, constituent elements of the electrolysis apparatus 70 are described focusing mainly on those other than the electrolyzer 50.

—Pump—

The pump 71 may be selected as appropriate without any particular limitations.

The pump 71 of the electrolysis apparatus 70 that can be used in the present embodiment may be provided as a cathode pump for feeding liquid to the cathode compartments 5*c* and an anode pump for feeding liquid to the anode compartments 5*a*, and these pumps may be separately operable.

—Gas-Liquid Separation Tank—

The gas-liquid separation tank 72 includes a hydrogen separation tank 72*h* that separates electrolyte and hydrogen gas and an oxygen separation tank 72*o* that separates electrolyte and oxygen gas.

The hydrogen separation tank 72*h* is connected to the cathode compartments 5*c* and the oxygen separation tank 72*o* is connected to the anode compartments 5*a*.

The electrolysis apparatus 70 includes two gas-liquid separation tanks 72: the oxygen separation tank 72*o* used for the anode compartments 5*a*; and the hydrogen separation tank 72*h* used for the cathode compartments 5*c*.

The gas-liquid separation tank 72 for the anode compartments 5*a* separates oxygen gas that has evolved in the anode compartments 5*a* and electrolyte, whereas the gas-liquid separation tank 72 for the cathode compartments 5*c* separates hydrogen gas that has evolved in the cathode compartments 5*c* and electrolyte.

Each of the gas-liquid separation tanks 72 is supplied with electrolyte and evolved gas that are discharged from the electrolytic cells 65 in a mixed state. If gas-liquid separation is not carried out appropriately, oxygen gas and hydrogen gas are mixed when electrolyte of the cathode compartments 5*c* and electrolyte of the anode compartments 5*a* are mixed, which leads to lower gas purity. In the worst case, there is a danger that detonating gas may be formed.

Gas and electrolyte that flow into the gas-liquid separation tank 72 separate with the gas as a gas phase that is an upper layer in the tank and the electrolyte as a liquid phase that is a lower layer in the tank. The degree of gas-liquid separation depends on the flux of electrolyte inside the gas-liquid separation tank 72, the speed at which produced gas bubbles rise, and the residence time inside the gas-liquid separation tank 72.

Electrolyte remaining after gas has been separated therefrom flows out from an outlet at the bottom of the tank and flows back into the electrolytic cells 65 to thereby form a circulation route. Oxygen or hydrogen gas discharged from a discharge port at the top of the tank is in a state containing alkaline mist. Therefore, it is preferable that a device that can liquidize excess mist and return it to the gas-liquid separation tank 72, such as a mist separator or a cooler, is installed downstream of the discharge port.

The gas-liquid separation tank 72 may include a liquid level gauge for determining the height of the liquid surface L of electrolyte accumulated inside the gas-liquid separation tank 72.

It is also preferable that the gas-liquid separation tank 72 includes a pressure release valve. The provision of this pressure release valve enables safe pressure reduction in a situation in which the design pressure is exceeded, even upon increased pressure caused by gas evolved in electrolysis.

An inlet to the gas-liquid separation tank 72 is preferably positioned higher than the surface of electrolyte from a viewpoint of improving gas-liquid separation performance, but this is not a limitation.

The surface of electrolyte inside the gas-liquid separation tank 72 is preferably set as higher than an upper surface of the electrolyzer with the aim of preventing lowering of the liquid surface L in the electrolyzer while circulation is suspended, but this is not a limitation.

It also preferable that a shut-off valve is provided between the electrolytic cells 65 and the gas-liquid separation tank 72, but this is not a limitation.

An alkali resistant metal such as nickel may be used as the material of the gas-liquid separation tank 72. On the other hand, in a case in which a general purpose metal such as iron is used as a tank housing material, an electrolyte contacting surface inside the tank may be subjected to coating treatment with a fluororesin or the like. However, this is not intended as a limitation on the material of the gas-liquid separation tank 72 in the present embodiment.

The capacity of the gas-liquid separation tank 72 is preferably small in consideration of installation space. However, when the capacity is too small, the liquid surface inside the tank may change in a case in which the pressure difference of the cathodes 2*c* and the anodes 2*a* increases or a case in which a value of the electrolysis current changes, and thus it is necessary to take into account this change.

Likewise, the tank height is preferably high because susceptibility to changes such as described above is higher with a low tank height.

—Water Replenisher—

The water replenisher 73 that is used in the electrolysis apparatus 70 may be selected as appropriate without any particular limitations.

Although water that is used may be from a general water supply, it is preferable to use deionized water, RO water, ultrapure water, or the like when operation over a long period is considered.

—Electrical Circuit—

The electrolysis apparatus 70 includes an electrolysis power supply (rectifier) 74. Moreover, an electrical circuit C that includes the electrolyzer 50 and the electrolysis power supply (rectifier) 74 may be formed. The electrolysis apparatus 70 may also include an external load 8 that is connected to the electrolyzer 50. In particular, it is preferable that an electrical circuit C and an external load 8 are included in present embodiment (I).

More specifically, in the example illustrated in FIG. 1, an anode 2*a* of an electrolytic cell 65 that constitutes an end part of the electrolyzer 50 and a positive electrode of the electrolysis power supply 74 are connected by a cable, and a cathode 2*c* of an electrolytic cell 65 that constitutes an end part of the electrolyzer 50 and a negative electrode of the electrolysis power supply 74 are connected by a cable. A connection between these cables is made through the external load 8 and a switch 9. This makes it possible to, for example, form a circuit of the electrolyzer 50 (all electrolytic cells 65) and the external load 8 by closing the switch 9 in a state in which the electrolysis power supply 74 is suspended in a suspension step. Moreover, although the external load 8 is connected to all of the electrolytic cells 65 of the electrolyzer 50 in the example illustrated in FIG. 1, the external load may be connected to a portion of the electrolyzer 50 of the electrolyzer 50 (not illustrated). This makes it possible to, for example, form a circuit of a portion of the electrolytic cells 65 of the electrolyzer 50 and the external load 8 in a suspension step.

—Storage Tank—

The electrolysis apparatus 70 can include a storage tank for storing electrolyte. The storage tank is preferably positioned further upward in a vertical direction than the electrolyzer 50 of the electrolysis apparatus 70. By connecting the storage tank to the electrolyzer 50 by piping or the like, it is possible to use gravity to inject electrolyte into the electrolyzer from inside of the storage tank. Moreover, a valve or the like may be provided in the piping or the like to enable appropriate adjustment of the flow rate.

—Other Components—

In addition to the electrolyzer 50, the gas-liquid separation tanks 72, and the water replenisher 73, the electrolysis apparatus 70 may include a rectifier 74, an oxygen concentration meter 75, a hydrogen concentration meter 76, a flow meter 77, a pressure gauge 78, a heat exchanger, a pressure control valve 80, and the like.

Moreover, the electrolysis apparatus 70 preferably further includes a detector for detecting suspension of electric power supply and a controller for automatically suspending the pump. Through inclusion of the detector and the controller, the effect of self-discharge can be efficiently reduced without human operation even under an electric power supply like renewable energy that has severe variation.

(Method of Operating Electrolysis Apparatus)

A method of operating an electrolysis apparatus of the present embodiment can be implemented using the electrolysis apparatus 70 of the present embodiment set forth above.

More specifically, the method of operating an electrolysis apparatus of the present embodiment may be a method of operating an electrolysis apparatus 70 that uses an electrolysis apparatus 70 including an anode compartment 5*a* including an anode 2*a* and a cathode compartment 5*c* including a cathode 2*c* and having the anode compartment 5*a* and the cathode compartment 5*c* partitioned from each other by a membrane 4, wherein the method includes: an energization step in which electrolysis of electrolyte in the anode compartment 5*a* and the cathode compartment 5*c* is performed; a suspension step in which electrolysis of electrolyte in the anode compartment 5*a* and the cathode compartment 5*c* is suspended; and a discharge step of, in the suspension step, electrically connecting an electrolyzer 50 of the electrolysis apparatus 70 to an external load 8 and adjusting a cell voltage to 0.1 V or less in 5 hours or less (present embodiment (I)). The method of operating an electrolysis apparatus 70 of present embodiment (I) makes it possible to inhibit degradation of electrodes 2 under a variable power supply.

Another method of operating the electrolysis apparatus of the present embodiment set forth above may be a method that includes: an energization step in which electrolysis of electrolyte in the anode compartment 5*a* and the cathode compartment 5*c* is performed; and a suspension step in which electrolysis of electrolyte in the anode compartment 5*a* and the cathode compartment 5*c* is suspended, wherein a liquid surface L of electrolyte in the anode compartment 5*a* and/or the cathode compartment 5*c* is positioned further upward in a vertical direction than an uncovered upper end 4*t* of the membrane 4 and at least part of the cathode is exposed to hydrogen gas in the suspension step. This method of operating an electrolysis apparatus 70 makes it possible to inhibit cathode degradation under a variable power supply and also to inhibit gas diffusion and mixing between the electrode compartments 5*a* and 5*c* via the membrane 4 while electrolysis is suspended.

First, constituent elements of the method of operating an electrolysis apparatus 70 are described in relation to the energization step.

The energization step is a step in which electrolysis of electrolyte in an anode compartment 5*a* and a cathode compartment 5*c* is performed. More specifically, in an electrolysis apparatus 70 such as illustrated in FIG. 1, the liquid pump 71 is used to feed electrolyte to the anode compartments 5*a* and the cathode compartments 5*c* of the electrolyzer 50 while performing forward energization through the rectifier 74 so as to perform electrolysis of electrolyte in the anode compartments 5*a* and the cathode compartments 5*c*. Electrolyte containing oxygen evolved in electrolysis and electrolyte containing hydrogen evolved in electrolysis are fed from the anode compartments 5*a* and the cathode compartments 5*c* to the gas-liquid separation tanks 72 and are subjected to gas-liquid separation. Electrolyte that has undergone gas-liquid separation in the gas-liquid separation tanks 72 is returned to the pump 71 while also replenishing water through the water replenisher 73. By circulating and performing electrolysis of electrolyte in the energization step in this manner, it is possible to perform electrolysis in an efficient manner.

Note that "forward energization" refers to passing electricity in a direction that makes it possible to obtain oxygen at the anodes 2*a* and hydrogen at the cathodes 2*c* through electrolysis of electrolyte using the electrolysis apparatus 70.

The electrolyte may be an alkaline aqueous solution in which an alkali salt is dissolved such as NaOH aqueous solution, KOH aqueous solution, or the like, for example.

The concentration of the alkali salt is preferably 20 mass % to 50 mass %, and more preferably 25 mass % to 40 mass %.

In the operation method set forth above, KOH aqueous solution of 25 mass % to 40 mass % is particularly preferable from a viewpoint of ion conductivity, kinematic viscosity, and freezing at low temperature.

The temperature of electrolyte inside the electrolytic cells 65 during the energization step is preferably 80° C. to 130° C.

By adopting the temperature range set forth above, high electrolysis efficiency can be maintained while also effectively inhibiting thermal degradation of components of the electrolysis apparatus 70, such as the gaskets 7 and the membranes 4.

The temperature of the electrolyte is more preferably 85° C. to 125° C., and particularly preferably 90° C. to 115° C.

The current density imparted to the electrolytic cells 65 in the energization step is preferably 4 $kA/m^2$ to 20 $kA/m^2$, and more preferably 6 $kA/m^2$ to 15 $kA/m^2$.

Particularly in a case in which a variable power supply is used, it is preferable that the upper limit for the current density is set within any of the ranges set forth above.

Note that although it is preferable in terms of production that electrolysis is performed with a preferred current density such as set forth above in the energization step, the energization step is also inclusive of a situation in which current flows to an extent falling below the preferred current density.

The pressure (gauge pressure) inside the electrolytic cells 65 in the energization step is preferably 3 kPa to 1,000 kPa, more preferably 3 kPa to 300 kPa, and even more preferably 3 kPa to 100 kPa.

Next, constituent elements of the method of operating an electrolysis apparatus 70 set forth above are described in relation to the suspension step.

The suspension step is a step in which electrolysis of electrolyte in an anode compartment 5*a* and a cathode compartment 5*c* is suspended. More specifically, oxygen evolves through electrolysis of electrolyte in the anode compartment 5*a* and hydrogen evolves through electrolysis of electrolyte in the cathode compartment 5*c* in the energization step, whereas this electrolysis is suspended in the suspension step. However, so long as the amount of energization is 1% or less of the maximum forward energization ($kA/m^2$) that is permitted in the electrolysis apparatus 70, forward energization may be performed in the suspension step. Note that the maximum forward energization is the maximum forward energization that is permitted as an operating condition in the electrolysis apparatus 70 that is used.

Moreover, although the pump 71 may be in a suspended or operated state in the suspension step, the pump 71 is preferably suspended.

In the method of operating an electrolysis apparatus 70 set forth above, it is preferable that, in the suspension step, the liquid surface of electrolyte (waterline of electrolyte) L inside the anode compartment 5*a* and/or cathode compartment 5*c* is positioned further upward in a vertical direction than an uncovered upper end 4*t* of the membrane 4 and that at least part of the cathode 2*c* is exposed to hydrogen gas as illustrated in FIGS. 5A, 5B, and 6. In such a situation, it is possible to inhibit degradation of the cathode 2*c* while also inhibiting gas diffusion and mixing between the electrode compartments 5*a* and 5*c* via the membrane 4 while electrolysis is suspended.

Note that the "uncovered upper end of the membrane" is the upper end of the membrane 4 in the vertical direction D1, or, in a case in which, for part of the membrane 4 itself at an upper end side in the vertical direction D1, part of a surface of the membrane 4 is covered by a gasket or the like used to fix the membrane 4 in place between outer frames 3 of the electrolyzer as illustrated in FIG. 5A or part of a surface of the membrane 4 is covered by a gasket 7 and also by a covering material 41 such as previously described as illustrated in FIG. 6, for example, the "uncovered upper end of the membrane" refers to the upper end 4*t* in the vertical direction D1 for a part of the membrane 4 that is not covered by the gasket 7, the covering material 41, or the like. In the present embodiment, the liquid surface L of electrolyte in the anode compartment 5*a* and the liquid surface L of electrolyte in the cathode compartment 5*c* may have the same or different positions in a vertical direction.

The method by which the liquid surface L of electrolyte in the anode compartment 5*a* and/or cathode compartment 5*c* is caused to be positioned further upward in a vertical direction than the uncovered upper end 4*t* of the membrane 4 is not particularly limited and may, for example, be a method in which a pump 71 is used to inject electrolyte into the anode compartment 5*a* and/or the cathode compartment 5*c* in the suspension step.

More specifically, the pump 71 can be continuously or intermittently operated in the suspension step so as to cause the liquid surface L in the anode compartment 5*a* and/or the cathode compartment 5*c* to be positioned further upward in a vertical direction than the uncovered upper end 4*t* of the membrane 4. This makes it possible to immerse at least one surface of the membrane 4 in electrolyte inside the electrode compartments 5*a* and 5*c*. Moreover, reduction of the amount of electrolyte inside the electrode compartments 5*a* and 5*c* during the suspension step can be inhibited, and electrolyte can be supplemented when reduction thereof does occur. Note that the pump 71 may be continuously operated in the suspension step to thereby continue circulation of electrolyte.

Moreover, the pump 71 may be continuously or intermittently operated after transition from the energization step to the suspension step or may be continuously or intermittently operated once a fixed time has passed after transition to the suspension step.

Furthermore, in a case in which the electrolysis apparatus 70 includes a cathode pump for feeding liquid to the cathode compartment 5*c* and an anode pump for feeding liquid to the anode compartment 5*a* as pumps 71, the cathode pump and the anode pump can be separately operated. This makes it possible to more efficiently inhibit an increase of hydrogen concentration in oxygen or an increase of oxygen concentration in hydrogen inside the cathode compartment 5*c*.

In another example of a method for causing the liquid surface L of electrolyte to be positioned further upward in a vertical direction than the uncovered upper end 4*t* of the membrane 4, in a case in which the electrolysis apparatus 70 includes a storage tank that stores electrolyte and in which the storage tank is positioned further upward in a vertical direction than the electrolyzer 50 of the electrolysis apparatus 70, electrolyte inside the storage tank may be injected into the anode compartment 5*a* and/or the cathode compartment 5*c* using gravity in the suspension step. This makes it possible to immerse at least one surface of the membrane 4 in electrolyte inside the electrode compartments 5*a* and 5*c* without using power. In this case, the anode compartment 5*a* and/or the cathode compartment 5*c* can be filled with electrolyte from inside the tank using gravity.

Note that in a case in which electrolyte is injected using a pump 71 as described above, the pump 71 may be suspended or may be operated to an extent that does not change the amount of liquid after injection. Moreover, in a case in which the pump 71 is suspended, an inlet or piping located downward of the electrode compartment 5*a* or 5*c* in a vertical direction (for example, electrolyte inlet 5*i*, anode inlet header (anode inlet hose) 10Oai, cathode inlet header (cathode inlet hose) 10Oci, etc.) may be closed through a shut-off valve or the like, for example.

In the operation method set forth above, it is preferable that the electrolyzer 50 includes a liquid level gauge that can measure a liquid surface L inside the anode compartment 5*a* and the cathode compartment 5*c* and that the liquid surface L inside the anode compartment 5*a* and the cathode compartment 5*c* is monitored through the liquid level gauge.

Moreover, in a case in which a liquid level gauge is provided, it is preferable that each liquid surface L is monitored by the liquid level gauge in the suspension step and that in a situation in which the liquid surface L inside the anode compartment 5*a* or cathode compartment 5*c* is positioned further downward in a vertical direction than the uncovered upper end 4*t* of the membrane 4, electrolyte is injected into the anode compartment 5*a* and/or cathode compartment 5*c* by the pump 71 such that the liquid surface L in the anode compartment 5*a* and/or cathode compartment 5*c* becomes positioned further upward in a vertical direction than the uncovered upper end 4*t* of the membrane 4. Alternatively, it is also preferable that the position of each liquid surface L is monitored by the liquid level gauge in the suspension step and that in a situation in which the liquid surface L inside the anode compartment 5*a* or cathode compartment 5*c* approaches the uncovered upper end 4*t* of the membrane 4, electrolyte is injected into the anode compartment 5*a* and/or cathode compartment 5*c* by the pump 71 so as to raise the liquid surface L.

This makes it possible to keep at least one surface of the membrane 4 in an immersed state even when the amount of electrolyte inside the electrode compartments 5*a* and 5*c* decreases during the suspension step.

In the operation method set forth above, it is preferable to use an electrolysis apparatus 70 in which at least part of the cathode 2*c* is present further upward than the uncovered upper end 4*t* of the membrane 4. In a case in which the liquid surface L of electrolyte in the cathode compartment 5*c* is positioned further upward in a vertical direction than the uncovered upper end 4*t* of the membrane 4 in the suspension step, it is possible to, in combination therewith, cause at least part of the cathode 2*c* to be exposed to a hydrogen gas layer that can be present inside the cathode compartment 5*c*. As a result, it is possible to inhibit gas diffusion and mixing between the electrode compartments 5*a* and 5*c* via the membrane 4 while also inhibiting degradation of the cathode 2*c* while electrolysis is suspended.

This inhibition of degradation of the cathode 2*c* is, more specifically, possible due to at least part of the cathode 2*c* being exposed to hydrogen gas in the suspension step, which makes it possible to oxidize the hydrogen in contact with the cathode 2*c* and thereby reduce oxidation of the cathode 2*c* and inhibit degradation of the cathode 2*c* even when a reverse current is generated in the cathode 2*c*.

From a viewpoint of sufficiently exposing at least part of the cathode 2*c* to hydrogen gas in the cathode compartment, it is preferable that hydrogen gas is supplied into the cathode compartment 5*c* from externally to the cathode compartment 5*c* in the suspension step so as to form a hydrogen gas layer in the cathode compartment 5*c*. Moreover, in a case in which a liquid level gauge is provided in the electrolyzer 50, it is preferable that the liquid level gauge is used to monitor whether the liquid surface L of electrolyte in the anode compartment 5*a* and/or cathode compartment 5*c* is positioned further upward in a vertical direction than the uncovered upper end 4*t* of the membrane 4 while also being positioned further downward in a vertical direction than the vertical direction position of the cathode 2*c*.

More specifically, the method by which hydrogen gas is supplied into the cathode compartment 5*c* from externally to the cathode compartment 5*c* so as to form a hydrogen gas layer in the cathode compartment 5*c* may be a method in which, using an electrolysis apparatus 70 for which the position of a vertical direction D1 upper end of a cathode electrolyte outlet 5*co* of the cathode compartment 5*c* is positioned further downward in the vertical direction D1 than the position of a vertical direction D1 upper end of an inner surface of an outer frame 3 of the cathode compartment 5*c* and further downward in the vertical direction D1 than a vertical direction D1 upper end of the cathode 2*c*, hydrogen gas is continuously injected via a hydrogen supply port provided in the cathode compartment 5*c* or upstream of the cathode compartment 5*c* in the distribution direction (for example, piping upstream of the cathode compartment 5*c*) in the suspension step so as to continuously form a hydrogen gas layer (hydrogen pocket) upward in the vertical direction D1 inside the cathode compartment 5*c*.

Note that the distribution direction is the direction of flow of electrolyte inside the electrolysis apparatus 70 when the energization step or the like is performed in the electrolysis apparatus 70.

The supply of hydrogen gas from externally to the cathode compartment 5*c* can be implemented by connecting a storage tank that stores hydrogen after a hydrogen separation tank 72*h* and the aforementioned hydrogen supply port by piping and by injecting hydrogen gas from the storage tank, or may be implemented by connecting a moveable gas cylinder filled with hydrogen to the aforementioned hydrogen supply port and injecting hydrogen gas from the gas cylinder.

In the operation method set forth above, it is preferable that, in a case in which the electrolysis apparatus 70 includes a supply path of electrolyte to the cathode compartment 5*c* (specifically, cathode distribution pipe 20Oci, cathode inlet header (cathode inlet hose) 10Oci, etc.) and a discharge path of electrolyte from the cathode compartment 5*c* (specifically, cathode collection pipe 20Oco, cathode outlet header (cathode outlet hose) 10Oco, etc.), the supply path and/or discharge path is electrically insulated from the cathode compartment 5*c* in the suspension step. More specifically, a valve made of resin may be provided in the supply path and/or discharge path (specifically, cathode distribution pipe 20Oci, cathode inlet header (cathode inlet hose) 10Oci, cathode collection pipe 20Oco, cathode outlet header (cathode outlet hose) 10Oco, etc.), and this valve may be closed in the suspension step so as to achieve electrical insulation. Moreover, by positioning the supply path upward in a vertical direction relative to the cathode compartment 5*c* and/or by positioning the discharge path upward in a vertical direction relative to the cathode compartment 5*c*, it is possible to form an electrically insulating gas layer in the supply path and/or discharge path in the suspension step by, for example, allowing electrolyte to drop under its own weight when a pump 71 is suspended or supplying an appropriate gas into the supply path or discharge path and withdrawing electrolyte.

By providing electrical insulation in the suspension step in this manner, it is possible to reduce the overall amount of reverse current that is generated in the cathode 2*c*. This electrical insulation is preferably provided from the start to the end of the suspension step.

In the method of operating an electrolysis apparatus set forth above, it is preferable that, in a case in which an electrical circuit including the electrolyzer and an electrolysis power supply (rectifier) 74 is formed in the electrolysis apparatus 70, this electrical circuit is shut off in the suspension step.

By shutting off the electrical circuit in this manner in the suspension step, it is possible to reduce the reverse current that is generated in the cathode 2*c* in the suspension step. More specifically, this shutting off can be performed using a circuit breaker, a disconnector, a switch, or a diode that impedes current in a reverse direction in the electrical circuit.

In the method of operating an electrolysis apparatus set forth above, it is preferable that, in a case in which the electrolysis apparatus 70 includes a plurality of elements 60 that each include an anode 2*a*, a cathode 2*c*, a partition wall 1 separating the anode 2*a* and the cathode 2*c* from each other, and an outer frame 3 bordering the partition wall 1, the plurality of elements 60 are stacked with membranes 4 interposed therebetween in a state in which they are electrically insulated from one another. As a result of the elements 60 being in an electrically insulated state from one another in this manner, it is possible to inhibit electrical charge that has accumulated in each of the elements 60 during the energization step from influencing other elements 60 during the suspension step.

Note that the method by which the plurality of elements 60 are placed in an electrically insulated state from one another is, more specifically, preferably by providing an electrically insulated state between the outer frames 3 of the elements 60, and can, more specifically, be achieved by increasing electrical insulation of gaskets 7 that are disposed between the elements 60, for example. The "electrical insultation" referred to herein is preferably an insulation resistance of 1 MΩ or more between the elements 60. Moreover, this can be achieved by covering a surface of each gasket 7 with an electrically insulating resin sheet (for example, a fluororesin such as polytetrafluoroethylene, etc.).

Next, constituent elements of the method of operating an electrolysis apparatus 70 of the present embodiment are described in relation to the discharge step.

The discharge step is a step of, in the suspension step, electrically connecting an electrolyzer 50 of the electrolysis apparatus 70 to an external load 8 and adjusting a cell voltage to 0.1 V or less in 5 hours or less.

In a case in which the method of operating an electrolysis apparatus 70 includes the discharge step, degradation of electrodes 2 under a variable power supply can be even further inhibited. More specifically, in a conventional method of operating an electrolysis apparatus 70, electrical charge that has accumulated in an anode 2*a* and a cathode 2*c* during an energization step causes the generation of a reverse current that flows backward in the anode 2*a* and the cathode 2*c* in a suspension step, and thus the electrical potentials of the electrodes 2 slowly change and thereby converge in accompaniment to this reverse current. However, in the process of electrical potential convergence, there is a certain period of time during which the electrical potential of the anode 2*a* or cathode 2*c* passes through a specific potential region in which corrosion of the electrode 2 itself occurs. Consequently, there is a concern that degradation of the electrodes 2 may occur upon repeated suspension and operation of electrolysis under a variable power supply. In the method of operating an electrolysis apparatus 70 set forth above, it is possible to sufficiently inhibit degradation of the electrodes 2 in a case in which an electrolyzer 50 of the electrolysis apparatus 70 is electrically connected to an external load 8 and in which a cell voltage is adjusted to 0.1 V or less in 5 hours or less because the electrical potentials of the anode 2*a* and the cathode 2*c* rapidly pass through the specific corrosion electrical potential region.

Note that when a reverse current is generated, electrical potentials of the electrodes 2 converge, and the cell voltage approaches 0 V during suspension of electrolysis as described above, it is possible to avoid the specific potential range in which corrosion of the electrode 2 occurs by adjusting the cell voltage to 0.1 V or less. Moreover, although the time taken to adjust the cell voltage to 0.1 V or less is preferably shorter from a viewpoint of inhibiting degradation of the electrodes 2, it is possible to inhibit degradation of the electrodes 2 while also avoiding excessive current flowing into the external load 8 in a short time and enabling appropriate heat generation in the external load 8 and design of heat release thereof so long as the time taken is 5 hours or less.

The time taken to adjust the cell voltage to 0.1 V or less in the discharge step is preferably 60 minutes or less, and more preferably 30 minutes or less.

Moreover, the cell voltage is preferably 0.1 V or less, and more preferably 0.0 V or less.

Note that the term "cell voltage" refers to the voltage for one electrolytic cell 65. In a case in which the discharging of the cell voltage is performed for all electrolytic cells 65 using an external load 8 such as illustrated in FIG. 1, the cell voltage can be determined by measuring the electrical potential difference between an anode 2*a* of an electrolytic cell 65 that constitutes an end part of the electrolyzer 50 and a cathode 2*c* of an electrolytic cell 65 that constitutes an end part of the electrolyzer 50 (i.e., by measuring at both ends of the external load 8, etc.) and then dividing this electrical potential difference by the number of electrolytic cells 65. Alternatively, the cell voltage can be determined by measuring a cell voltage for each electrolytic cell 65 and then dividing an aggregate value of the cell voltages by the number of electrolytic cells. Further alternatively, the cell voltage of a specific single electrolytic cell 65 may be taken to be the cell voltage that is a criterion in the discharge step.

The discharge step may be performed when the voltage of the electrolyzer 50 falls below a specific threshold value in the suspension step. This makes it possible to inhibit degradation of each electrode 2 and suppress the amount of heat generated in the external load 8 by setting the specific threshold value as a value preceding an electrical potential region in which corrosion of the electrodes 2 occurs, for example.

Note that the threshold value can be freely set in accordance with the amount of heat generated in the external load 8, heat release design thereof, and so forth, but is preferably 0.5 V or more in terms of cell voltage, more preferably 1.0 V or more in terms of cell voltage, and even more preferably 1.2 V or more in terms of cell voltage.

The method of operating an electrolysis apparatus 70 set forth above can more suitably be adopted in a case in which an electrolyzer 50 of the electrolysis apparatus 70 is a bipolar electrolyzer and includes a plurality of electrolytic cells 65, and, in particular, in a case in which the electrolyzer 50 includes 30 or more electrolytic cells 65.

In other words, a conventional method of operating an electrolysis apparatus 70 also suffers from the following problem.

In an electrolyzer 50 having a plurality of electrolytic cells 65 stacked in series, a reverse current that flows in a suspension step is comparatively large in electrolytic cells 65 located centrally in the electrolyzer 50 and is comparatively small in electrolytic cells 65 located at the ends of the electrolyzer 50. Consequently, the electrode potential change that occurs during the suspension step proceeds rapidly at the center and slowly at the ends.

Therefore, in a conventional method of operating an electrolysis apparatus 70, electrodes 2 of electrolytic cells 65 located centrally and electrodes 2 of electrolytic cells 65 located at the ends differ in terms of the time that they are exposed to a corrosion electrical potential during a suspension step, and thus a distribution dependent on the positions of the electrolytic cells 65 arises for degradation of electrodes 2, and degradation of electrodes 2 in electrolytic cells 65 located at the ends becomes more apparent.

Besides this distribution for degradation of electrodes 2, the following problem also arises. Namely, the electrical potentials of electrodes 2 gradually change when a reverse current is generated as described above, which results in evolution of hydrogen in an anode compartment 5*a* and evolution of oxygen in a cathode compartment 5*c* when the electrical potential of an anode 2*a* reaches a specific hydrogen evolution potential and the electrical potential of a cathode 2*c* reaches a specific oxygen evolution potential. Moreover, in an electrolyzer 50 in which a plurality of electrolytic cells 65 are stacked in series, these specific electrical potentials are reached earlier in centrally located electrolytic cells 65. Since a reverse current continues to flow even in the centrally located electrolytic cells 65 thereafter due to the voltage of electrolytic cells 65 located at the ends, there is a concern that a localized increase of hydrogen concentration in oxygen inside the anode compartment 5*a* and oxygen concentration in hydrogen inside the cathode compartment 5*c* may arise for the centrally located electrolytic cells 65.

In response to this problem, the method of operating an electrolysis apparatus 70 set forth above that includes the previously described discharge step can equalize discharge through the external load 8 and can thereby suppress a distribution of electrode degradation and promote discharge such that the duration of exposure to a corrosion electrical potential is shortened.

With regards to the aforementioned increase of hydrogen concentration in oxygen inside an anode compartment 5*a* and oxygen concentration in hydrogen inside a cathode compartment 5*c*, equalization of discharge through the external load 8 makes it possible to reduce the reverse current after the electrical potentials of electrodes 2 in centrally located electrolytic cells 65 have reached the hydrogen evolution potential and the oxygen evolution potential, and thus can suppress the amount of hydrogen evolved in the anode compartment 5*a* and the amount of oxygen evolved in the cathode compartment 5*c*.

By rapidly reducing the voltage of the electrolyzer 50 using the external load 8, it is also possible to reduce the danger of electrocution when performing maintenance or the like and to shorten the time between suspending electrolysis and starting maintenance.

In the method of operating an electrolysis apparatus 70 set forth above, in a case in which an electrolyzer 50 of the electrolysis apparatus 70 is a bipolar electrolyzer and includes a plurality of electrolytic cells 65, discharging can be performed for all of the electrolytic cells 65 in the discharge step using an external load 8 such as illustrated in FIG. 1. Alternatively, discharging can be performed for just a portion of the plurality of electrolytic cells 65 (i.e., for one electrolytic cell 65 or a plurality of electrolytic cells 65). By performing discharging for a portion of the electrolytic cells 65, electrodes 2 in these electrolytic cells 65 can be more sufficiently protected from degradation.

In a case in which discharging is performed for a portion of the electrolytic cells 65, this can be performed by forming an electrical circuit that includes these electrolytic cells 65 and an external load 8, and, more specifically, can be performed for a portion of the electrolytic cells 65 by connecting an anode 2*a* of an electrolytic cell 65 at an upstream end in a forward current direction and a cathode 2*c* of an electrolytic cell 65 at a downstream end in the forward current direction by a cable or the like with the external load 8 interposed therebetween.

Moreover, in a case in which discharging is performed for a portion of the electrolytic cells 65, the cell voltage can be determined by measuring an electrical potential difference between an anode 2*a* of an electrolytic cell 65 that constitutes an end part of electrolytic cells 65 that are a target for which the discharge step is performed and a cathode 2*c* of an electrolytic cell 65 that constitutes an end part in the electrolyzer 50 (i.e., by measuring at both ends of the external load 8, etc.) and then dividing the electrical potential difference by the number of electrolytic cells 65 in the same manner as when the cell voltage is measured for all electrolytic cells 65. Alternatively, the cell voltage can be determined by measuring a cell voltage for each of the electrolytic cells 65 and then dividing an aggregate value of the cell voltages by the number of electrolytic cells.

In the operation method set forth above, retained electrical charge of the cathode 2*c* is preferably 0.1 times or less retained electrical charge of the anode 2*a*. The method of operating an electrolysis apparatus 70 can suitably be adopted in a situation in which the electrolysis apparatus 70 is operated using electrodes such as described above.

The retained electrical charge of the cathode 2*c* is the amount of electrical charge retained by a cathode 2*c* of a cathode compartment 5*c* for which control of the amount of hydrogen gas based on the retained electrical charge (C) is performed when electrolysis of electrolyte in the energization step is suspended (i.e., at the end of the energization step). More specifically, the retained electrical charge (C) of the cathode 2*c* is determined by performing forward energization in the cathode 2*c* until sufficient reduction occurs, subsequently suspending the forward energization and measuring the electrical potential of the cathode 2*c* while passing a reverse current, and taking a time aggregated value of the reverse current until the electrical potential of the cathode 2*c* becomes equal to the electrical potential of the anode 2*a* to be the retained electrical charge that is retained by the cathode 2*c*. The retained electrical charge (C) of the anode 2*a* can be measured in the same way as the retained electrical charge of the cathode 2*c*.

Moreover, the method by which the retained electrical charge of the cathode 2*c* is set as 0.1 times or less the retained electrical charge of the anode 2*a* in the operation method set forth above may be through appropriate selection of materials of the anode 2*a* and the cathode 2*c*, for example.

In the present embodiment, the constituent elements of the electrolysis apparatus 70 set forth above can be used to produce an electrolysis apparatus 70 having a configuration such as illustrated in FIG. 1, for example, but this is not a limitation.

In the method of operating an electrolysis apparatus of the present embodiment, the effects set forth above become apparent when a variable power supply such as sunlight or wind power is used.

Although the above provides an illustrative description of an electrolysis apparatus and a method of operating an electrolysis apparatus of an embodiment of the present disclosure with reference to the drawings, the electrolysis apparatus and method of operating an electrolysis apparatus according to the present disclosure are not limited to the examples described above, and alterations can be made in the embodiment described above as appropriate.

INDUSTRIAL APPLICABILITY

According to the present disclosure, it is possible to inhibit anode and cathode degradation that can occur during suspension of electrolysis under a variable power supply such as sunlight or wind power. Moreover, according to aspect (II) of the present disclosure, it is possible to provide an electrolysis apparatus that can also inhibit gas diffusion and mixing between electrode compartments via a membrane.

REFERENCE SIGNS LIST

1 partition wall
2 electrode

2*a* anode
2*c* cathode
2*c*1 main cathode part
2*c*2 auxiliary cathode part
2*c*3 conductor
3 outer frame
4 membrane
41 covering material
4*t* uncovered upper end of membrane
5 electrode compartment
5*a* anode compartment
5*c* cathode compartment
5*i* electrolyte inlet
5*o* electrolyte outlet
5*ai* anode electrolyte inlet
5*ao* anode electrolyte outlet
5*ci* cathode electrolyte inlet
5*co* cathode electrolyte outlet
6 flow rectifying plate
7 gasket
8 external load
9 switch
10 header
100 external header
10Oai anode inlet header (anode inlet hose)
10Oao anode outlet header (anode outlet hose)
10Oci cathode inlet header (cathode inlet hose)
10Oco cathode outlet header (cathode outlet hose)
20 conduit
20Oai anode distribution pipe
20Oao anode collection pipe
20Oci cathode distribution pipe
20Oco cathode collection pipe
50 bipolar electrolyzer
51*g* fast head, loose head
51*a* anode terminal element
51*c* cathode terminal element
51*r* tie rod
51*i* insulating plate
60 bipolar element
65 electrolytic cell
70 electrolysis apparatus
71 pump
72 gas-liquid separation tank
72*h* hydrogen separation tank
72*o* oxygen separation tank
73 water replenisher
74 rectifier
75 oxygen concentration meter
76 hydrogen concentration meter
77 flow meter
78 pressure gauge
80 pressure control valve
102*a* anode
102*c* cathode
104 membrane
104*t* uncovered upper end of membrane
105*a* anode compartment
105*c* cathode compartment
107 gasket
165 electrolytic cell
D1 given direction along partition wall (vertical direction)
Z zero-gap structure
L waterline
C electrical circuit

The invention claimed is:

1. A method of operating an electrolysis apparatus comprising an electrolyzer, the electrolyzer being a bipolar electrolyzer and including a plurality of electrolytic cells connected in series that each includes an anode compartment including an anode and a cathode compartment including a cathode and in which the anode compartment and the cathode compartment are partitioned from each other by a membrane, the method comprising:

an energization step in which electrolysis of electrolyte in the anode compartment and the cathode compartment is performed;

a suspension step in which electrolysis of electrolyte in the anode compartment and the cathode compartment is suspended; and a discharge step of, in the suspension step, electrically connecting the electrolyzer to an external load and adjusting a cell voltage to 0.1 V or less in 5 hours or less, wherein the discharge step is implemented when voltage of the electrolyzer falls below a specific threshold value in the suspension step, the anode of a first electrolytic cell that constitutes a first end part of the plurality of electrolytic cells and a positive electrode of an electrolysis power supply are connected by a first cable, the cathode of a second electrolytic cell that constitutes a second end part of the plurality of electrolytic cells and a negative electrode of the electrolysis power supply are connected by a second cable, the first and second cables are connected through the external load and a switch, and the specific threshold value is set as a value preceding an electrical potential region in which corrosion of the anode or the cathode occurs, the value being set in accordance with a specific amount of heat generated in the external load.

2. The method of operating an electrolysis apparatus according to claim 1, wherein the cell voltage is adjusted to 0.1 V or less in 60 minutes or less in the discharge step.

3. The method of operating an electrolysis apparatus according to claim 1, wherein the discharge step is implemented for a portion of the plurality of electrolytic cells.

4. The method of operating an electrolysis apparatus according to claim 1, wherein the electrolyzer of the electrolysis apparatus includes 30 or more electrolytic cells.

5. The method of operating an electrolysis apparatus according to claim 1, wherein retained electrical charge of the cathode included in the cathode compartment is 0.1 times or less retained electrical charge of the anode included in the anode compartment.

* * * * *